US010039332B2

(12) United States Patent
Sokolowski et al.

(10) Patent No.: US 10,039,332 B2
(45) Date of Patent: Aug. 7, 2018

(54) SPORTS GARMENTS WITH ENHANCED VISUAL AND/OR MOISTURE MANAGEMENT PROPERTIES

(71) Applicant: NIKE, Inc., Beaverton, OR (US)

(72) Inventors: Susan L. Sokolowski, Portland, OR (US); Kirk M. Mayer, Portland, OR (US); Amir H. Morgan, Hillsboro, OR (US); Alan W. Reichow, Beaverton, OR (US); Andrea J. Staub, Portland, OR (US); Stephanie J. Scott, Portland, OR (US)

(73) Assignee: NIKE, INC., Beaverton, OR (US)

( * ) Notice: Subject to any disclaimer, the term of this patent is extended or adjusted under 35 U.S.C. 154(b) by 192 days.

(21) Appl. No.: 14/921,563

(22) Filed: Oct. 23, 2015

(65) Prior Publication Data

US 2016/0037834 A1 Feb. 11, 2016

Related U.S. Application Data

(63) Continuation of application No. 13/411,235, filed on Mar. 2, 2012, now Pat. No. 9,241,516.
(Continued)

(51) Int. Cl.
*A41D 13/01* (2006.01)
*A63B 71/06* (2006.01)
(Continued)

(52) U.S. Cl.
CPC ..... *A41D 13/01* (2013.01); *A41D 13/0015* (2013.01); *A41D 31/02* (2013.01);
(Continued)

(58) Field of Classification Search
CPC .... A41D 13/01; A41D 13/0015; A41D 27/08; A41D 13/0002; A41D 1/02; A41D 1/04;
(Continued)

(56) References Cited

U.S. PATENT DOCUMENTS 2,513,646 A * 7/1950 Holterhoff ..... D06C 23/00 26/69 R
3,683,419 A 8/1972 Lewis
(Continued)

FOREIGN PATENT DOCUMENTS

CN 1993160 A 7/2007
CN 101242749 A 8/2008
(Continued)

OTHER PUBLICATIONS

European Office Action dated Jul. 13, 2016 in Application No. 12751838.9, 4 pages.
(Continued)

*Primary Examiner* — Amy Vanatta
(74) *Attorney, Agent, or Firm* — Shook Hardy & Bacon, L.L.P.

(57) ABSTRACT

A garment, such as a sports uniform, may provide visibility zones and/or flicker zones to enhance the ability of teammates to perceive the wearer. Different zones on a garment may have different sets of visual properties that may contrast with one another and/or a visual background. A denier differential between layers of a garment may facilitate moisture transport across the layers of the garment. Flicker zones may be discrete from or combined with visibility zones. One or more zones of a garment may also be substantially non-reflective at wavelengths associated with the visual background encountered while wearing the garment.

16 Claims, 18 Drawing Sheets

Related U.S. Application Data

(60) Provisional application No. 61/448,908, filed on Mar. 3, 2011.

(51) Int. Cl.

| | |
|---|---|
| ***A41D 13/00*** | (2006.01) |
| ***A41D 31/02*** | (2006.01) |
| *A63B 102/24* | (2015.01) |
| *A63B 102/14* | (2015.01) |
| *A63B 102/22* | (2015.01) |
| *A63B 102/18* | (2015.01) |

(52) U.S. Cl.
CPC ..... *A63B 71/0622* (2013.01); *A41D 2400/20* (2013.01); *A41D 2400/60* (2013.01); *A63B 2071/0661* (2013.01); *A63B 2071/0694* (2013.01); *A63B 2102/14* (2015.10); *A63B 2102/18* (2015.10); *A63B 2102/22* (2015.10); *A63B 2102/24* (2015.10); *A63B 2243/007* (2013.01); *A63B 2243/0025* (2013.01); *A63B 2243/0037* (2013.01); *A63B 2243/0066* (2013.01)

(58) Field of Classification Search
CPC . A41D 1/08; A41D 1/06; A41D 1/089; A41D 27/02; A41D 31/0011; A41D 31/00; A41D 31/0088; A41D 31/0094; A41D 31/02; A41D 2600/10; A63B 2071/0661; A63B 2071/0694; A63B 71/0622; A63B 2243/0025; A63B 2243/007; A63B 2243/0037; A63B 2243/0066
See application file for complete search history.

(56) References Cited

U.S. PATENT DOCUMENTS

| | | | | |
|---|---|---|---|---|
| 3,811,213 | A * | 5/1974 | Eaves | G09F 13/00 40/437 |
| 3,837,007 | A * | 9/1974 | Girest | A41D 27/10 2/126 |
| 3,861,790 | A | 1/1975 | Tamura et al. | |
| 3,898,696 | A | 8/1975 | Campanis et al. | |
| 4,255,380 | A * | 3/1981 | Bjorkland | G09F 19/14 264/132 |
| 5,050,982 | A | 9/1991 | Meissner et al. | |
| 5,065,458 | A | 11/1991 | Johnson | |
| 5,478,239 | A | 12/1995 | Fuerst et al. | |
| 5,588,156 | A | 12/1996 | Panton | |
| 5,946,721 | A | 9/1999 | Dance | |
| 6,044,492 | A | 4/2000 | Krogh | |
| 6,125,472 | A | 10/2000 | Nakagawa | |
| 6,175,960 | B1 | 1/2001 | Knittel | |
| 6,745,395 | B2 * | 6/2004 | Noble | A42B 1/004 2/12 |
| 6,755,525 | B2 | 6/2004 | Reichow | |
| 6,811,258 | B1 | 11/2004 | Grant | |
| 6,893,127 | B2 | 5/2005 | Reichow et al. | |
| 7,073,208 | B2 | 7/2006 | Penque, Jr. et al. | |
| 7,934,267 | B2 * | 5/2011 | Nordstrom | A41D 13/0015 2/115 |
| 2003/0024093 | A1 * | 2/2003 | Willauer, Jr. | D06B 11/0056 28/160 |
| 2003/0150043 | A1 * | 8/2003 | Koppes | A41D 13/01 2/69 |
| 2003/0196251 | A1 | 10/2003 | Lee | |
| 2004/0143882 | A1 * | 7/2004 | Gardner | A41D 13/01 2/81 |
| 2004/0158911 | A1 | 8/2004 | Amnuel | |
| 2004/0180199 | A1 * | 9/2004 | Kang | D02G 3/182 428/364 |
| 2005/0037844 | A1 | 2/2005 | Shum et al. | |
| 2005/0136768 | A1 * | 6/2005 | Huang | A43B 1/0036 442/301 |
| 2005/0268371 | A1 | 12/2005 | Meekins | |
| 2006/0026731 | A1 | 2/2006 | Qashou | |
| 2006/0185401 | A1 * | 8/2006 | Shirasaki | D04B 21/14 66/203 |
| 2007/0000007 | A1 | 1/2007 | MacDonald et al. | |
| 2007/0016999 | A1 | 1/2007 | Harber et al. | |
| 2007/0028362 | A1 | 2/2007 | Cash | |
| 2007/0144221 | A1 * | 6/2007 | Sytz | D04B 1/18 66/171 |
| 2007/0281812 | A1 | 12/2007 | Smith et al. | |
| 2007/0285744 | A1 | 12/2007 | Boyer et al. | |
| 2008/0189824 | A1 | 8/2008 | Rock et al. | |
| 2009/0178174 | A1 | 7/2009 | Cash, Jr. | |
| 2010/0137064 | A1 | 6/2010 | Shum et al. | |
| 2010/0325773 | A1 | 12/2010 | Rock et al. | |
| 2011/0173735 | A1 | 7/2011 | Polanish | |
| 2013/0061366 | A1 | 3/2013 | Pezzimenti | |
| 2014/0205814 | A1 * | 7/2014 | Hwang | B44C 1/1712 428/195.1 |
| 2015/0176825 | A1 * | 6/2015 | Bernstein | F21V 23/0471 2/93 |

FOREIGN PATENT DOCUMENTS

| | | | |
|---|---|---|---|
| CN | 101272704 | A | 9/2008 |
| WO | 2012119106 | A2 | 9/2012 |

OTHER PUBLICATIONS

Reichow, et al., "Introduction to Behavioral Optometry", Sports Vision, 1993, 75 pages, Optometric Extension Program Foundation, United States.

Ferreira, "An Overview of Research in Sports Vision: its History and an Optometric Perspective", The South African Optometrist, Dec. 2003, pp. 142-149, vol. 62, No. 4, Auckland Park, South Africa.

Coffey, et al., "Visual Performance Enhancement in Sports Optometry", Sports Vision 1995, pp. 158-177, Butterworth-Heinermann, United States.

Cardall, "Contact Lenses in Sport: a General Overview", Optician, Jan. 13, 2006, pp. 22-25, vol. 231, No. 6034, United States.

Rouse, et al., "A Comparison Study of Dynamic Visual Acuity Between Athletes and Nonathletes", Journal of the American Optometric Association, Dec. 1988, pp. 946-950, vol. 59, No. 12, United States.

Koenig, "Practicing Perception: Eyes Can Be Trained to be More Effective", USA Today Baseball Weekly, 1996, 3 pages, United States.

Coffey, et al., "Optometric Evaluation of the Elite Athlete," Problems in Optometry, Mar. 1990, pp. 32-59, vol. 2, No. 1, United States.

Reichow, et al., "A Comparison of Contrast Sensitivity in Elite Athletes Versus a Normal Population", American Journal of Optometry and Physiological Optics, Dec. 15, 1986, vol. 63, No. 82, United States.

Farrow, et al., "An Investigation of the Effectiveness of Bolle's Competivision Sport-Glasses on Tennis Performance", Clinical and Experimental Optometry, Jul.-Aug. 2000, pp. 226-231, vol. 83, No. 4.

Herdman, et al., "Computerized Dynamic Visual Acuity Test in the Assessment of Vestibular Deficits", The American Journal of Otology, 1998, pp. 790-796, vol. 19, No. 6, United States.

Tian, et al., "Dynamic Visual Acuity During Transient and Sinusoidal Yaw Rotation in Normal Unilaterally Vestibulopathic Humans", Experimental Brain Research, Feb. 8, 2001, pp. 12-25, vol. 137, Springer-Verlag, United States.

Reichow, et al., "Ultraviolet and Short Wavelength Visible Light Exposure: Why Ultraviolet Protection Alone is Not Adequate", Journal of Long-Term Effects of Medical Implants, 2006, pp. 315-325, vol. 16, No. 4, Begell House, Inc., United States.

International Search Report with Written Opinion dated Jun. 8, 2012 in Application No. PCT/US12/27556, 10 pages.

(56) References Cited

OTHER PUBLICATIONS

International Preliminary Report on Patentability dated Mar. 27, 2014 in Application No. PCT/US12/27556, 7 pages.
Non-Final Office Action dated Jan. 16, 2015 in U.S. Appl. No. 13/411,235, 12 pages.
European Search Report dated Feb. 17, 2015 in Application No. 12751839.9, 7 pages.
Notice of Allowance dated Sep. 15, 2015 in U.S. Appl. No. 13/411,235, 8 pages.
European Office Action dated Dec. 16, 2015 in Application No. 12751838.9, 4 pages.
European Search Report dated Feb. 5, 2018 in Application No. 17196975.1, 7 pages.

* cited by examiner

SPORTS GARMENTS WITH ENHANCED VISUAL AND/OR MOISTURE MANAGEMENT PROPERTIES

CROSS-REFERENCE TO RELATED APPLICATIONS

This application is a continuation of U.S. application Ser. No. 13/411,235, filed Mar. 2, 2012, entitled "Sports Garments With Enhanced Visual And/Or Moisture Management Properties," which claims priority to U.S. Provisional Pat. App. No. 61/448,908, filed Mar. 3, 2011, entitled "Double Layered Garment With Enhanced Visual And/Or Moisture Management Properties." Both U.S. application Ser. No. 13/411,235 and U.S. Provisional App. No. 61/448,908 are incorporated herein by reference in their respective entirety.

STATEMENT REGARDING FEDERALLY SPONSORED RESEARCH OR DEVELOPMENT

Not applicable.

TECHNICAL FIELD

The present application relates to garments and, more particularly, sporting uniforms. The present application further relates to garments that enhance the perception of teammates during competition to improve coordinated athletic competition.

BACKGROUND OF THE INVENTION

Both the comfort and visual properties of sporting uniforms can be important to performance. Team sports such as soccer require a teammate to visually perceive and identify his or her teammates during play in order to complete passes, coordinate defense, and the like. Enhancing the visual perception of a teammate has traditionally been accomplished by using different colors of uniform for competing teams, but the use of team colors alone merely distinguishes between players on different teams without enhancing the abilities of teammates to visually perceive a player. Further, such sports create considerable perspiration by participants, the moisture management properties of sports uniforms can be important to the comfort and ultimate performance of the athlete wearing the uniform.

BRIEF SUMMARY OF THE INVENTION

The present application describes garments that may be used as part of a sports uniform that can provide enhanced visibility for members of a team viewing the athlete wearing the uniform. The present application further describes a garment that may provide advantageous moisture management characteristics to move perspiration from the skin of an athlete to the outer layer of the garment to permit evaporation using a denier differential mechanism.

Garments or uniforms in accordance with the present invention may improve the perception of the location and movement of teammates during competition, and hence improve the coordinated quality of play, by providing one or more enhanced visual properties. For example, visibility zones on a garment or a uniform comprising multiple garments may visually contrast with other regions of the garment or uniform and/or the visual background experienced by teammates during competition. Visual contrast may be created using luminance contrasts and/or color contrasts. For example, color contrasts selected using a color definition such as the CIE (1931) Standard Chromaticity Diagram to permit both normally sighted and color deficient individuals to equally perceive the color contrast of the garment. Visibility to teammates may be further enhanced by creating a spectral window corresponding with the visual background in which all or part of a garment or uniform is substantially non-reflective. Visibility to teammates may also be enhanced by locating visibility zones on a garment or uniform at locations that, when the uniform is worn during competition, correspond to lines of sight of teammates. Further, visibility zones may be located at or near the wearer's joints or "hinge points" when the uniform or garment is worn during competition to provide greater information regarding the location, orientation, speed, and/or acceleration of the wearer to teammates. Visibility zones may alternatively or additionally outline all or part of the lateral portions of a wearer's body to make the wearer more readily visible to teammates and to assist teammates in evaluating the orientation and movement of the wearer during play.

Garments or uniforms in accordance with the present invention may also improve the perception of the location and movements of teammates during competition by creating visual change perceivable by teammates. For example, a varying pattern on a garment or uniform may enhance the visibility of the wearer to teammates, particularly in the peripheral vision of teammates. Another way to create visual change in garments or uniforms in accordance with the present invention may use "flicker" to enhance the visibility of a wearer to teammates. Flicker occurs when a visually property changes rapidly. Flicker may be created in garments or uniforms in accordance with the present invention in various ways. For example, a garment or uniform may have flicker zones on the inside of a wearer's legs, causing a flicker effect while the wearer runs. Flicker zones may similarly be located on the sides (where they will be intermittently obscured by the wearer's arms), on the inside portion of a shoe, or at other locations as appropriate for the sport in question and the particular type of garment. By way of further example, the shape, texture, and/or contour of the surface of a garment or uniform may cause various zones with contrasting visual properties to come in or out of view to a teammate when the wearer moves. For example, molded portions of materials such as thermal plastics, adhesives, etc., may be used to form flicker zones. Further, heat transfers, decals, patches, or other materials may be affixed to a garment to create a flicker zone. As yet another example, aerographic techniques may be used to remove fibers to reveal other fibers to create a flicker zone. By way of yet further example, garments or uniforms in accordance with the present invention may comprise multiple contrasting layers, with the outer layer providing openings through which an inner layer may be viewed, either continuously or intermittently, as the wearer moves and the outward facing layer stretches or moves. By selecting yarns with contrasting luminance and/or color positions on the CIE (1931) Standard Chromaticity Diagram to create one or multiple layers of a garment, a visual contrast may be created between the skin facing layer and the outward facing layer that facilitates perception of the position and motion of a wearer by his or her teammates. Holes or windows permitting viewing of an inner layer may be positioned on a garment selectively such that viewing angles common for teammates may coincide with the contrasting zones created, while optionally minimizing the view obtained by opponents.

Further, garments or uniforms in accordance with the present invention may be formed from multiple layers with dernier per filament values selected so as to create a denier differential across the layers of a garment to facilitate the movement of moisture from the skin of an athlete to the surface of the garment for evaporation. Openings in layers of a garment may also be located to enhance the cooling of the wearer.

Objects, advantages, and novel features of the invention will be set forth in part in the description which follows, and in part will become apparent to those skilled in the art upon examination of the following, or may be learned by practice of the invention.

BRIEF DESCRIPTION OF THE DRAWINGS

The drawings described herein are for illustrative purposes only of selected examples and not all possible implementations, and are not intended to limit the scope of the present disclosure

DETAILED DESCRIPTION OF THE INVENTION

Figure 1:
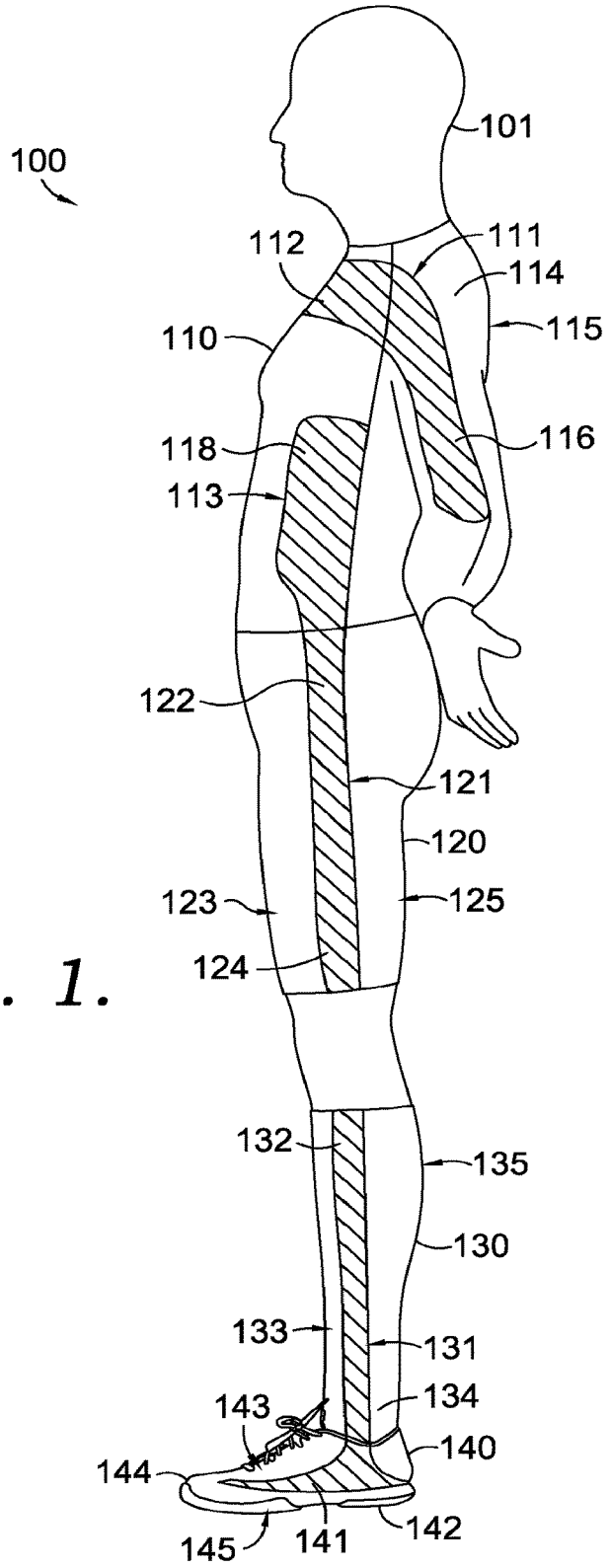
FIG. 1 illustrates a profile view of an athlete wearing a sports uniform in accordance with the present invention.

A garment in accordance with the present invention may be a garment, a sports uniform or any sports uniform component. The term "garment" is used herein to refer to anything worn during athletic competition, such as jerseys, shirts, shorts, pants, socks, shoes, safety equipment, sweat bands, etc.

A garment in accordance with the present invention may advantageously create visual contrast to facilitate recognition of the wearer by his or her teammates or others during competition or training. The visual contrast created by a garment in accordance with the present invention may be between different zones on the garment itself and/or between the garment and the visual background experienced by teammates of the wearer during athletic competition. Visibility zones may be located on a garment or uniform to be particularly visible to teammates and/or to provide particularly useful information to teammates. The visual properties that create contrast for a garment created in accordance with the present invention may luminance, color location in color spaces, peak reflectivity at given spectral windows, non-reflectivity at a given spectral window, or any other contrasting visual property. These zones may be formed by selectively applying dyes, by attaching graphics at desired locations, by structuring the knit or weave of a textile to create contrasting visual properties, by selecting yarns having contrasting visual properties and manipulating the knit or weave to control which yarns are on the surface of a textile, by providing moldable or shapeable portions of a garment and shaping that portion to provide the desired effect, by constructing a garment from different textiles or materials having contrasting visual properties, by affixing heat transfers or decals to a garment, or through any other means. For example, the present invention may utilize differing yarns, graphics, constructions, etc. to create a luminance contrast between different zones or regions of a garment. Similarly, yarns, graphics, constructions, etc. may be selected so as to create a color contrast on a CIE (1931) Standard Chromaticity Diagram, optionally separated by a percentage of a chromatic blend limit, to enhance the ability of teammates to visually perceive the wearer of the garment. Alternatively and/or additionally, zones may be created to have contrasting luminances. Further, one or more zones of a garment may be substantially non-reflective in a spectral window associated with a visual background experienced when the garment is worn. For example, if the garment is a soccer jersey, the expected visual background may be the grass of a soccer pitch, the sky above the stadium, or the crowd in the stands, in which case one or more zones of a garment may be selected so as to not reflect at the dominate wave lengths of the visual background. Garments or uniforms in accordance with the present invention may also have flicker zones that create rapid visual change that may be perceived by teammates. Flicker zones may be distinct from visibility zones, but also may comprise a visibility zone.

Some specific examples of visual stimulus and applications thereof are described with respect to a particular activity—soccer, as it is called in the United States, or football as it is known in much of the world. This activity is selected as an example because of its worldwide appeal and familiarity. The methods and applications described herein are applicable to other team sports such as basketball, baseball, soccer, lacrosse, hockey, rugby, and American football. The described methods and applications are also applicable to activities other than sports, including other commercial and recreational activities. Examples of uniforms and other articles of clothing are described, but other items can be configured in a similar manner.

Referring now to FIG. 1, in example of a sports uniform in accordance with the present invention is illustrated. An athlete 101 wearing a sports uniform 100 may be wearing various garments as components to the sports uniform 100. For example, a jersey 110, shorts 120, socks 130, and shoes 140 may together comprise a uniform for soccer. Of course, additional components may be added to uniform 100 or omitted from uniform 100, and other types of sports may utilize other component garments or differently configured garments in uniform 100.

Jersey 110 may comprise a first visibility zone 111. First visibility zone 111 may contrast with other portions of jersey 110 that may be adjacent to first visibility zone 111, such as second zone 113 and third zone 115. First visibility zone 111 may extend along jersey 110 to cover portions of the wearer's chest 112, shoulder 114 and elbow 116 when jersey 110 is worn, although other configuration that extend first visibility zone 111 over more or less of jersey 110 and wearer 101. FIG. 1 illustrates a single continuous first visibility zone 111, but multiple discreet visibility zones at various locations, such as chest 112, shoulder 114 and elbow 116 may be utilized additionally and/or alternatively. An example of a discontinuous second visibility zone 113 is illustrated at side 118 of wearer 101. First visibility zone 111 and/or second visibility zone 113 may possess a first set of visual properties, and one or more of the first set of visual properties may create a high contrast with a second set of visual properties possessed by second zone 113 and/or third zone 115 and/or the visual background experienced by teammates during competition. Further, while first visibility zone may contrast with both second zone 113 and third zone 115, all of the first visibility zone 111, the second zone 113, and the third zone 115 may contrast with a visual background. For example, all zones 111, 113, 115 may be substantially non-reflective in a spectral window associated with a background, as described herein. Further, second zone 113 and third zone 115 may differ from one another or may be identical in their visual properties, and more or fewer zones may be present on a garment in accordance with the present invention.

Still referring to FIG. 1, uniform 100 may further comprise shorts 120. Shorts 120 may comprise a first visibility zone 121, a second zone 123 and a third zone 125, which may resemble the various zones 111, 112, 113, 115 of jersey 110. As illustrated in FIG. 1, first visibility zone 121 continuously extends from the hip 122 to approximately the knee 124 of the wearer when the shorts 120 are worn. As described above with regard to jersey 110, first visibility zone 121 may possess a first set of visual properties, one or more of which may visually contrast with second zone 123 and/or third zone 125 and/or the visual background as described herein. Second zone 123 and third zone 125 may be identical or different in their visual properties, and more or fewer zones may be present on a garment in accordance with the present invention. Further, first visibility zone 121 may extend continuously or in a broken fashion between hip 122 and knee 124 when worn. Further, the first visibility zone 121 may merely extend to near the knee 124 of wearer, depending upon the length and fit of shorts 120. Further, first visibility zone 121 may be located at a single hinge point, may be located between hinge points (i.e., on the thigh between the hip 122 and knee 124), or may be located elsewhere.

Still referring to FIG. 1, uniform 100 may further comprise socks 130. Socks 130 may comprise a first visibility zone 131 that visually contrasts as described herein with a second zone 133 and a third zone 135. First visibility zone 131 may extend from near the knee 132 to near the ankle 134 of the wearer when sock 130 is worn, but may be differently sized and/or located. FIG. 1 illustrates a continuous first visibility zone 131 extending from near the knee 132 to near the ankle 134, but discontinuous zones may also be used. Zones 131, 133, 135 may possess sets of visual properties as described above to create high contrast.

Still referring to FIG. 1, a uniform may further comprise a shoe 140. Shoe 140 may comprise a first visibility zone 141 possessing a first set of visual properties that visually contrasts as described herein with visual properties possessed by a second zone 143 and/or a third zone 145 and/or a visual background. As illustrated in FIG. 1, first visibility zone 141 extends continuously from near the heel 142 to near the toe 144 when shoe 140 is worn. As with the other garments comprising uniform 100, first visibility zone 141 need not continuously extend from heel 142 to toe 144 of wearer, may have a different size or positions, etc. Also as described above, zones 141, 143, 145 may possess visual properties contrasting with one another and/or a visual background.

While FIG. 1 illustrates a view of one side of a uniform 100 worn by an athlete 101, uniform 100 has a second side that may have additional second visibility zones corresponding to the first visibility zones illustrated in FIG. 1. For some sports and/or some positions in various sports, different locations, sizes, and/or visual properties may be desired for different sides of the athlete wearing the uniform 100 or different heights on uniform 100. In some instances, a second visibility zone may be omitted entirely or one or more zones in addition to those described in the example of FIG. 1 may be provided. For example, multiple visibility zones having different sets of visual properties may be provided at different locations. Further, as described herein, flicker zones may be provided as well.

Assignment of a specific visual stimulus to a particular zone of a garment or uniform may be associated with improved perception, and thus improved decision making by a wearer's teammate. For example, a visual stimulus can be selected to increase the accuracy of passes between teammates. In some typical examples, visual stimuli configured for peripheral vision are preferred. Various kinds of visual stimuli can be used. For central vision or peripheral vision, luminance contrast and object detail can be used to provide an appropriate visual stimulus. For central vision perception, color characteristics (such as hue or saturation) can be used. A just noticeable color difference is typically associated with dominant wavelength differences of between about 2 nm to 4 nm, but depends on spectral region. Differences in luminance can also be used, with differences of 1-1.5% typically observable for either central or peripheral vision. For central vision, details as small as about 1 arcmin are legible, while details as small as about 0.5 arcsec can be detected. For peripheral vision, details as small as about 10 arcmin are legible, while details as small as about 0.5 arcsec can be detected. Angular spacings of about 0.6 arcmin or greater permit objects to be perceived as separate objects in either central or peripheral vision. Misalignments of objects can be detected that are as small as about 3-5 arcsec ("hyperacuity"). Peripheral vision can detect flicker at rates as high as about 80 Hz-100 Hz, while central vision can detect flicker at rates less than about 20 Hz. In an example, visual stimuli for central vision, ranked in order from most to least sensitive, are lateral motion, luminance contrast, color contrast, and flicker. For peripheral vision, a similar ranking is lateral motion, flicker, luminance contrast, and color contrast. Visual factors are generally interdependent, and can depend on observer adaptation or recent exposure of the observer to a bright object. Visual stimuli can also be affected by environmental conditions such as stadium lighting, hazy or foggy weather, or direct sunlight. Backgrounds such as grass, stadium seating, spectator apparel can also be significant.

Figure 2:
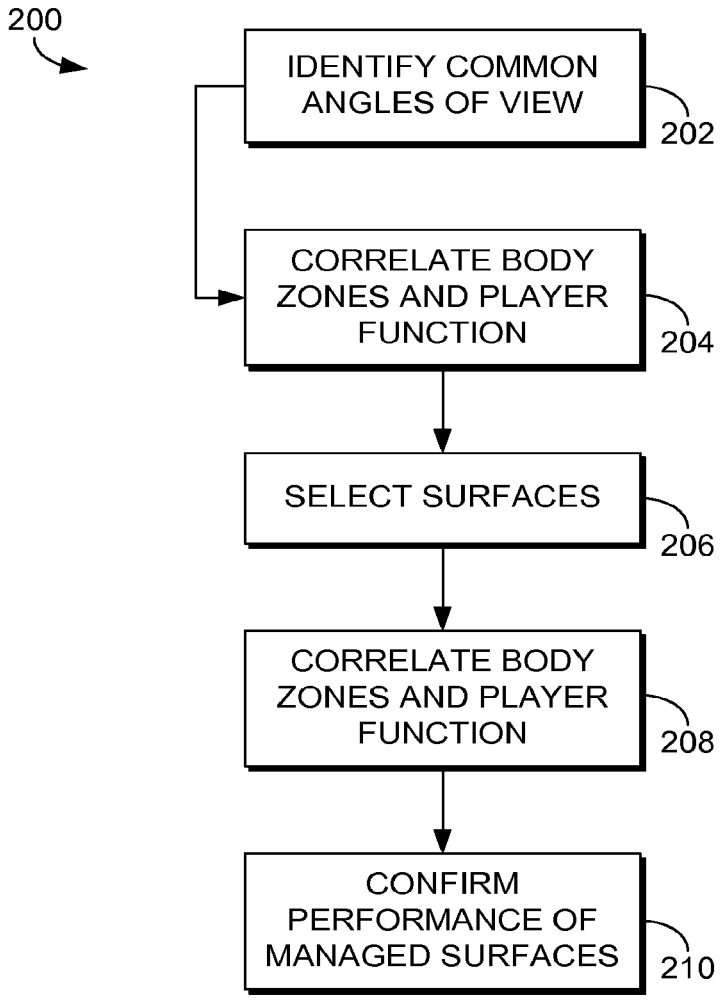
FIG. 2 is a block diagram of a method of managing visual stimuli and properties of zones on a garment in accordance with the present invention.

An example visual stimulus management method 200 is illustrated in FIG. 2. For a selected activity, a set of activities, or a selected situation in one or more activities, a distribution of common angles of view are identified in a step 202. For example, common angles of view experienced by a passer and a pass receiver in a soccer match can be identified. Such a distribution provides a quantitative assessment of what portions of teammates are visible to each other while passing. The identification of viewing angles can be based on one or more matches or practices using a diverse player group, or using a player group of a particular skill level and experience. For example, common angles of view can be different for relatively inexperienced youth league players and premier league professionals. Particular situations other than routine passing can be selected for common view angle identification, and common view angles can differ for different locations on a soccer pitch as well as for different player positions. Typically, common angles of view are activity specific, and observations of an activity are used to establish activity-specific common view angles.

In an example, numbers of "through balls" in an attacking third of a soccer pitch were observed and tabulated for premiership football matches. (Through balls are defined as passes that penetrate the defense and allow attacking forwards a scoring opportunity.) In such a tabulation, through balls were noted as a function of pass angle (i.e., angle with respect to the passer's line of sight at the time of the pass), pass distance (distance from passer to intended receiver), and receiver body position. For convenient analysis, pass angles were noted as in a range of 0-20 degrees, 20-40 degrees, or greater than 40 degrees. Pass distances were recorded in ranges of 0-5 m, 5-10 m, 10-15 m, and 15-20 m. Receiver body position was recorded as front (facing the passer), side, or back. In the observed matches, as pass distance increased, passers tended to play more through balls to receivers in wide positions (i.e., at larger angles from the passer's line of sight). The greatest number of through balls was played when the receiver was positioned side-on to the passer. The lowest number of through balls was played to the backs of receiving players. For smaller pass distances, fewer through balls were played at wider pass angles.

Figure 3:
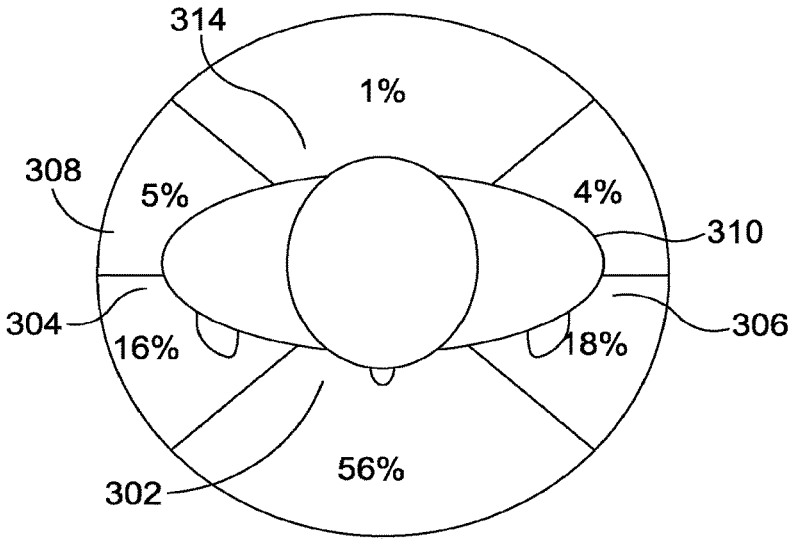
FIG. 3 illustrates a distribution of measured viewing angles of passes directed to teammates in a soccer match.

A depiction of common view angles is shown in FIG. 3, based on observations of about twenty premier league soccer matches. Approximately 56% of all forward passes were made while viewing a front 302 of a pass receiver. About 16% and 18% were made while viewing a right front side 304 and a left front side 306, respectively. About 1% were made viewing a player back 312, and 5% and 4%, respectively, were made viewing a right back side 308 and a left back side 310, respectively. To assist in the most commonly encountered passing situations, visual zones may be created on the fronts and/or sides of player uniforms. For example, if passing to player sides is to be improved, corresponding front and/or side regions of player uniforms can be visually enhanced.

Figure 4:
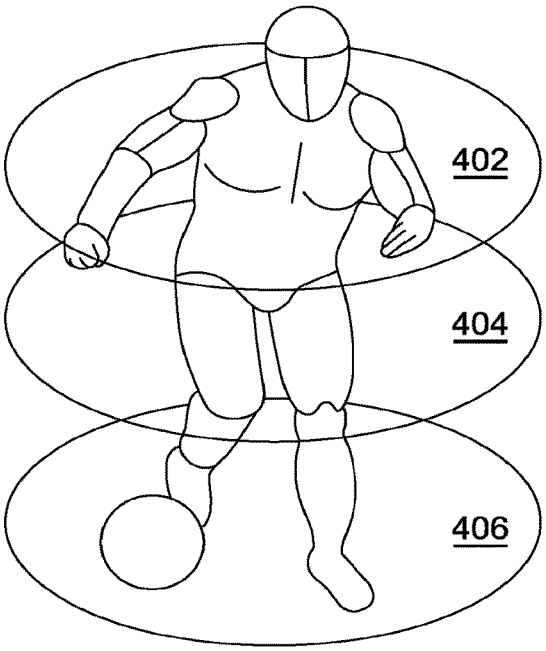
FIG. 4 illustrates a representative division of a player's body into zones associated with typical distances from which the zone is viewed and the relative body segment speed within the body segment zones.

While common views can be recorded based on activity observation, and visual stimuli associated with these views can be provided by, for example, coloring or otherwise treating player uniform portions as described herein, additional considerations can improve the effectiveness of treating player uniform portions in this way. With reference to FIG. 4, for a particular activity (soccer), body zones 402, 404, 406 can be associated with corresponding motion speeds and viewing distances. For example, the body zone 402 is commonly viewed from a considerable distance, and typical player movements associated with this body zone are relatively slow. Such a characterization of this body zone can differ greatly in different activities. Because most use of the arms is forbidden in soccer, arm movements tend to be slow and provide only generally indicators of player activity. The body zone 404 is associated with intermediate viewing distances, and fast, large scale player movements. For example, a player dribbling at midfield can be moving rapidly to cover a large distance to approach an opponent's goal. The body zone 406 can be associated with fast movements viewed at near distances. In soccer, this body zone is particularly important as passing is based on player movements in this zone. Sports or other activities in which hand/arm motions are significant can be associated with different zone divisions and different zone characterizations. Adjacent body portions of a player can be associated with different zones. For example, portions of a player's arms can be assigned to different zones based on anticipated types of motion.

Based on body segment zones and characterizations, activity-significant portions of selected body zones can be treated to provide visual characteristics such as zone-specific enhanced visibility. Referring again to FIG. 2, in a step 204, body zones and player functions are correlated. In step 206, surfaces are selected for visual management based on, for example, a frequency with which the surfaces are encountered, an estimated importance of the surface during the activity, or likely benefit to be obtained by managing visual stimuli on such surfaces. In step 208, visual stimuli provided by the selected surfaces are managed to enhance or otherwise configure visual stimuli produced by the surface. In some cases, additional testing is performed in step 210 to confirm performance enhancement.

Visual stimuli provided by surfaces of team uniforms can be managed using luminance, reflectivity or non-reflectivity in spectral windows, texture, color, gray level, patterning, fluorescence, iridescence, or other visually observable surface properties. To preserve traditional uniform appearance, one or more color parameters such as hue, saturation, and value associated with a selected surface portion may be configured to provide, for example, a selected contrast, while remaining color parameters are selected so that the uniform retains a traditional appearance. For example, a relatively dark surface portion can be configured to contrast with a relatively light surface portion while other color parameters are selected in accordance with traditional team colors, logos, and designs. For visual stimuli targeting peripheral vision, gray values can be used that can provide an intended stimulus in a selected zone while not detracting from a traditional team colors or team appearance.

Visual stimuli may be selected based on either central vision, peripheral vision, or both. For example, visual stimuli can be based on relative differences in apparent darkness, such as a pattern of light areas on a dark background or dark area on a light background to provide luminance contrast. For application to soccer, a high proportion of passes are played to receivers that are at angles of about 20-40° to the passer, and only the receiver's side or front faces the passer. Therefore, visibility zones associated with visual properties can be assigned to jersey chests, sleeves, and front sides as well as sides of shorts and socks. Alternatively, visibility zones can be assigned to one or more of a jersey side, sides of shorts, sides of socks, or sides of shoes. Such visibility zones may be positioned and selected to aid a passer in rapid location of an intended pass recipient. Visibility zones can be defined in one or more locations of, for example, a jersey, shorts, or both. Such visibility zones can be created by applying dyes, by attaching materials attached to a garment, by forming opening in different layers of a garment, etc. Visibility zones may contain markers or other distinct visible areas within them. Visibility zone and/or marker size can be selected based on anticipated or intended viewing distances so that the marker can be noted during the activity. Some representative sizes for various distances are summarized in the table below.

| Separation (m) | Zone area ($cm^2$) |
|---|---|
| 5 | 2.5 |
| 10 | 3.75 |
| 15 | 5.6 |
| 20 | 7.5 |

Visibility zone area as a function of passer-receiver separation.

Zones of a uniform or garment, such as illustrated in FIG. 1, may possess contrasting visual properties. Such zones may be configured to, for example, enhance the ability of teammates to identify, locate, and evaluate speed, acceleration, direction of movement, orientation, etc., of a teammate. For example, a first zone and a second zone may have spectral reflectances associated with substantially complementary colors. Color space locations of the substantially complementary colors may be separated by at least 50% of a chromatic blend limit. In additional examples, a chromatic blend line associated with the complementary colors may be separated from a central white color space location by less than 25% of the chromatic blend limit. In further examples, color space locations of the substantially complementary colors may be separated by at least 75% of a chromatic blend limit. In other examples, a chromatic blend line associated with the complementary colors may be separated from a central white color space location by less than 10% of the chromatic blend limit. In further examples, substantially complementary colors C1 and C2 may be associated with respective CIE L-a-b coordinates ($C1_L$,$C1_a$,$C1_b$) and ($C2_L$, $C2_a$,$C2_b$), wherein a color difference $$CD = \sqrt{(C1_a - C2_a)^2 + (C1_b - C2_b)^2}$$

is greater than about 50. In further examples, the color difference CD is greater than about 100. In other examples, a total color difference TCD between the first region and the second region is at least about 50 or at least about 100, wherein $$TCD = \sqrt{(C1_a - C2_a)^2 + (C1_b - C2_b)^2 + (C1_L - C2_L)^2}\ .$$

In additional examples, the substantially complementary colors have a luminance contrast between the first region and the second region of at least 50%.

Methods of selecting colors for a sports garment or uniform may comprise defining a chromatic blend line and selecting a first color location and a second color location on the chromatic blend line, wherein the first color location and the second color location are separated by at least 50% of a chromatic blend limit (CBL). A first color and a second color may be selected based on the first color location and the second color location. In a representative example, the chromatic blend line may be separated from a central white color space location by less than about 20% of the chromatic blend limit. In additional examples, a color vision deficiency to be accommodated may be selected, and the chromatic blend line may be selected to be substantially perpendicular to an associated color vision deficiency line of confusion. In further examples, a background spectral window may be selected based on an anticipated background for viewing the sports item. A reflectance of at least one of the first color and/or the second color may be reduced in at least a portion of the background spectral window. In other examples, the first color and the second color are selected to provide a predetermined luminance contrast.

Figure 5:
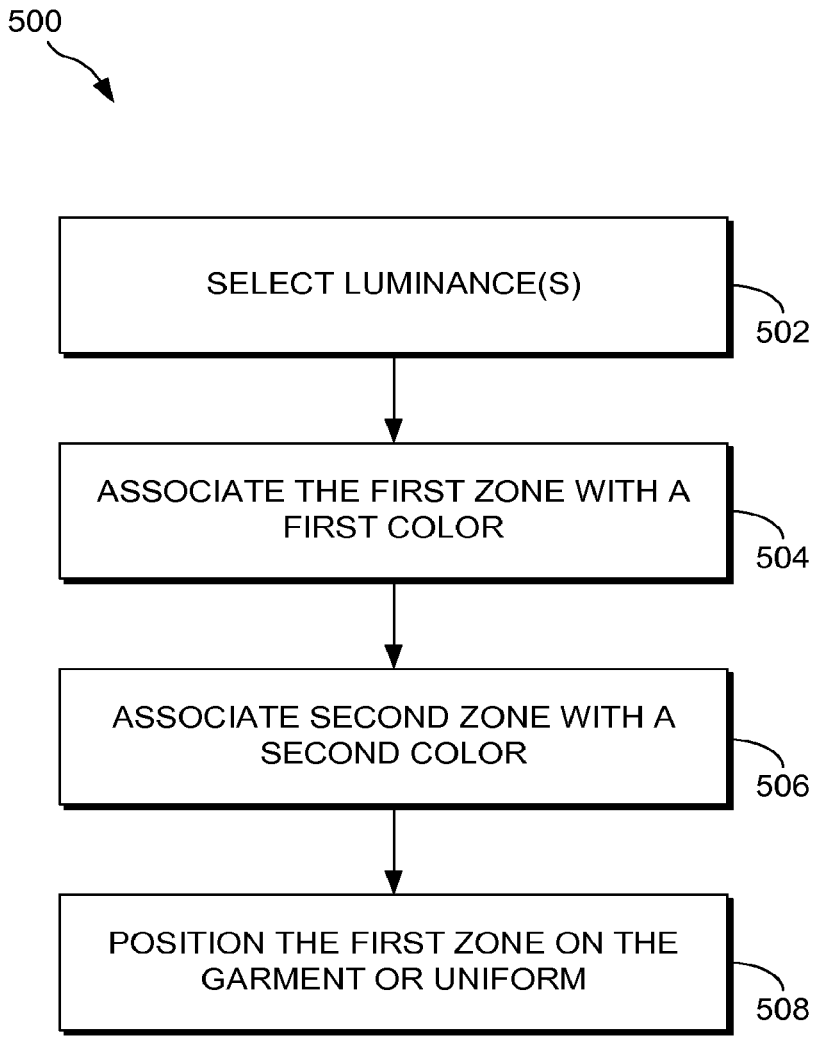
FIG. 5 is a block diagram of a method for enhancing the visual of a sports uniform in accordance with the present invention.

Turning now to FIG. 5, a flow diagram illustrating an exemplary method for enhancing the visibility of a sports garment or uniform in accordance with the present invention is illustrated and designated generally as reference numeral 500. In step 502 luminance for zones of a garment may be selected to establish a desired degree of luminance contrast between zones and/or a visual background.

Next, as indicated at blocks 504 and 506, the first zone is associated with a first color and the second zone is associated with a second color. First zone and/or second zone may be a visibility zone, a flicker zone, or other zone as described herein. The first color may be substantially black and the second color may be substantially white, or colors may be selected as described below. The present invention, however, is not limited to a specific color scheme.

Next, as indicated at block 508, the first zone is positioned on the garment. Examples of how to locate a first zone on a soccer uniform are described above. However, other types of garments on uniforms for other types of sports are also within the scope of the present invention.

Any of steps 502, 504, 506, and 508 may be repeated to place additional zones on a garment or uniform and that these zones may have different shapes, sizes, and/or visual properties than those established in an earlier iteration of method, 500. However, the iteration of steps of method 500 is not required in accordance with the present invention. Further, additional zones may optionally be created on a garment or uniform without departing from the scope of the present invention.

Figure 6:
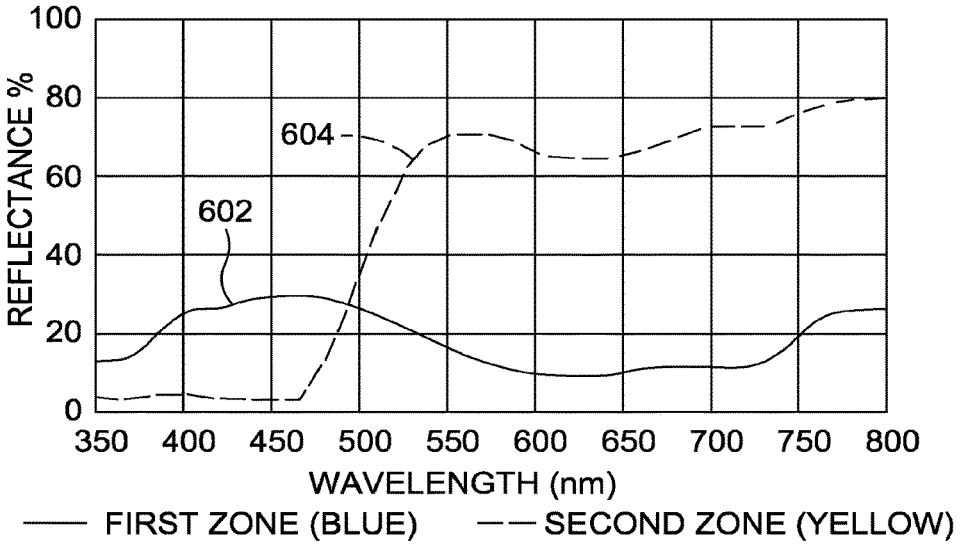
FIG. 6 illustrates an example of reflectances of zones on a garment in accordance with the present invention as a function of wavelength.
Figure 7:
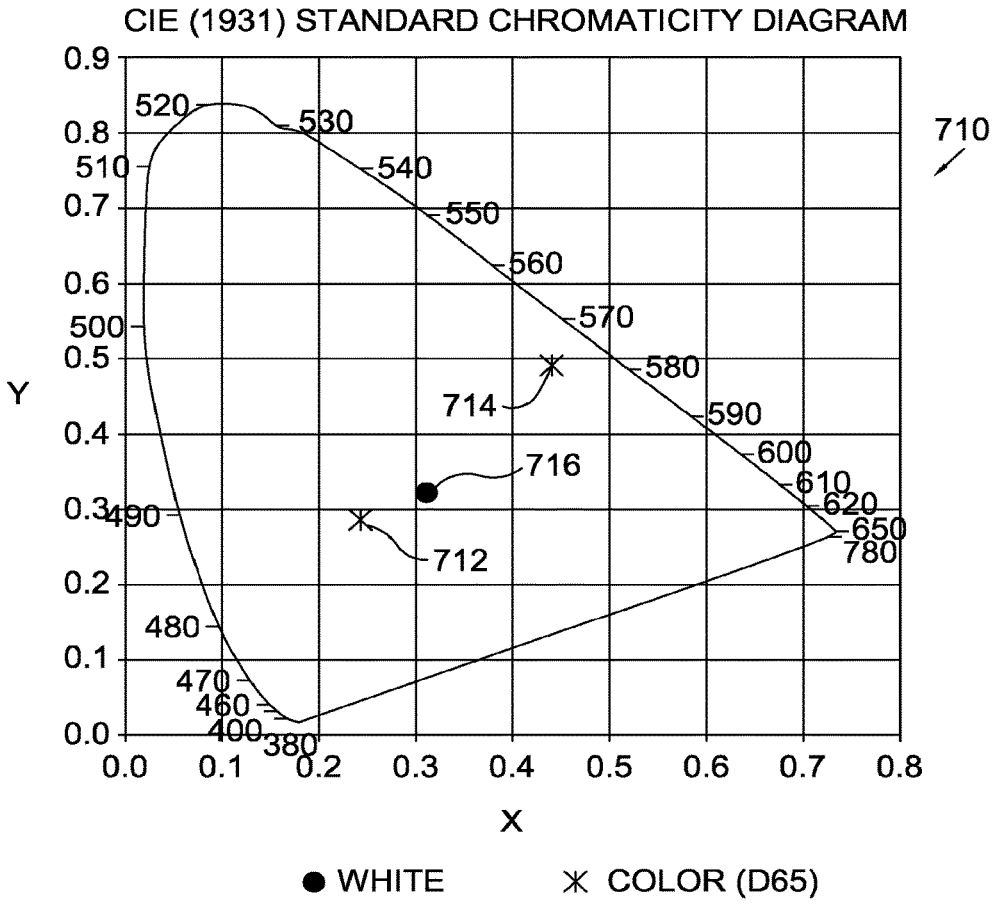
FIG. 7 illustrates example of CIE color coordinates of zones of a garment in accordance with the present invention as illuminated by bright sunlight.
Figure 8:
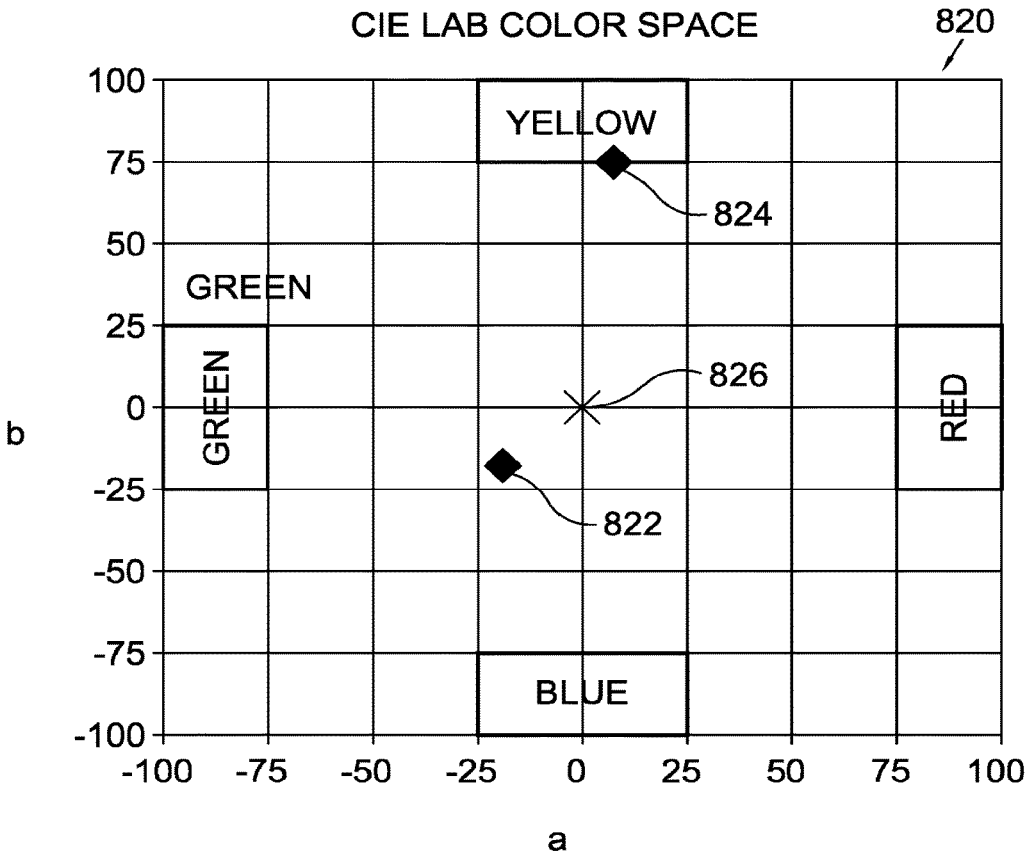
FIG. 8 illustrates example CIE L-a-b color coordinates of zones of a garment in accordance with the present invention associated with the color coordinates of FIG. 7.

A representative selection of visibility-enhancing coloration for a uniform in accordance with the present invention is illustrated in FIGS. 6-8. Referring to FIG. 6, a first zone 602 and a second zone 604 are selected that appear blue and yellow, respectively. These colors are merely exemplary, and other colors may be used. First zone and/or second zone may be a visibility zone, a flicker zone, or other zone as described herein. CIE X-Y coordinate locations 712, 714 associated with the first zone reflectance and the second zone reflectance, respectively, as illuminated by sunlight are shown in a CIE standard chromaticity diagram 710 in FIG. 7. For reference, a location 716 of a standard white (sunlight or illuminate D65) is also shown. The CIE Z-coordinate that is associated with a total reflectance or luminance is not shown on the chromaticity diagram 710. The locations 712, 714 are widely separated and are opposite with respect to the location 716. CIE L-a-b color coordinates associated with the reflectances 702, 704 are shown in FIG. 8 as locations 822, 824, respectively on a L-a-b representation 820. The locations 822, 824 are widely separated and opposite with respect to a location 826 associated with white illumination, but in other examples, colors associated with color coordinates that are not opposite with respect to the location 826 can be used. In FIG. 8, an L-a-b luminance coordinate L is not shown.

Color selection and characterization can be conveniently described based on a CIE L-a-b Color Space. A Total Color Difference (TCD) between colors having coordinates ($L_1$, $a_1$, $b_1$) and ($L_2$, $a_2$, $b_2$) in such a color space can be defined as TCD=

$$\sqrt{(a_1-a_2)^2+(b_1-b_2)^2+(L_1-L_2)^2}\,.$$

A Color Difference (CD) under isoluminant conditions, i.e., assuming identical brightnesses of the colors, can be defined as $$CD=\sqrt{(a_1-a_2)^2+(b_1-b_2)^2}\,.$$

In a CIE Lab Color Space, complementary colors can be associated with color coordinates along any axis that passes through or near a central "white" point. Horizontal, vertical, or other axes can be used. For example, a vertical axis is associated with blue/yellow, a horizontal axis is associated with red/green, and oblique axes through opposite corners of an L-a-b coordinate systems are associated with orange/blue-green and purple/green-yellow. Luminance contrast be calculated using a spectral reflectance function SRF (λ) (reflectance as a function of wavelength λ) of an object with respect to a particular light source. For the examples presented herein, a light source having a spectral distribution D65(λ) and similar to sunlight is used. In addition, a human spectral sensitivity function HSSF(λ) is used. Object luminance coordinate L can be calculated as:

$$L=\frac{\int SRF(\lambda)D65(\lambda)HSSF(\lambda)d\lambda}{\int D65(\lambda)HSSF(\lambda)d\lambda}.$$

Luminance contrast for objects having luminances $L_1$ and $L_2$ can be calculated as $|(L_1-L_2)/L_1|$, wherein $L_1>L_2$.

Color contrast can be associated with a distance between the locations 822, 824 on the L-a-b space representation 820, and a color difference can be associated with a total distance between the locations 822, 824. For example, colors $C_1$ and $C_2$ that are associated with respective CIE L-a-b coordinates ($C1_L$,$C1_a$,$C1_b$) and ($C2_L$,$C2_a$,$C2_b$), can be associated with a color difference $$CD=\sqrt{(C1_a-C2_a)^2+(C1_b-C2_b)^2}\,,$$

and in typical examples enhanced-visibility colors (EVCs) have color differences of greater than about 50, or greater than about 75, or greater than about 100. In other examples, a total color difference TCD between colors $C_1$ and $C_2$ is at least about 100, wherein $$TCD=\sqrt{(C1_a-C2_a)^2+(C1_b-C2_b)^2+(C1_L-C2_L)^2}\,.$$

In additional examples, the substantially complementary colors have a luminance contrast of the first region and the second region of at least 50%. In other examples, color contrast can be associated with horizontal or other separations in an L-a-b representation.

Color differences associated with FIGS. 6-8 are summarized in Table 1. CIE dominant wavelengths for the first zone and the second zone reflectances of FIG. 6 are approximately 482 nm (blue) and 572 nm (yellow), respectively. However, the blue first zone may be replaced with a zone having a reflectance at a shorter wavelength (i.e., purple). Other wavelengths may alternatively be used without departing from the scope of the present invention. Luminance contrast is about 70% and color difference (CD) is about 98. Total color difference (TCD) is about 103.

TABLE 1

Color coordinates associated with the spectral reflectances of FIG. 6.

| Color Coordinates | FIRST ZONE (Faded Blue) | SECOND ZONE (Greenish-Yellow) |
|---|---|---|
| x | 0.2394 | 0.4356 |
| Y | 0.2646 | 0.4901 |
| z | 0.4960 | 0.0743 |
| L | 48.51 | 81.22 |
| a | −18.45 | 6.64 |
| b | −18.14 | 76.58 |

Selection of contrasting colors for zones on a garment or uniform may be based on an anticipated use environment. For example, for a soccer uniform that is to be used in matches played on natural grass pitches, colors may be selected to enhance mutual contrast between the uniform and the grass pitch. In other examples, contrast based on a different backgrounds such as blue sky, cloud cover, stadium seating, or other immediate surround to a playing surface such as trees, playground structures, or spectator clothing may be selected.

Figure 9:
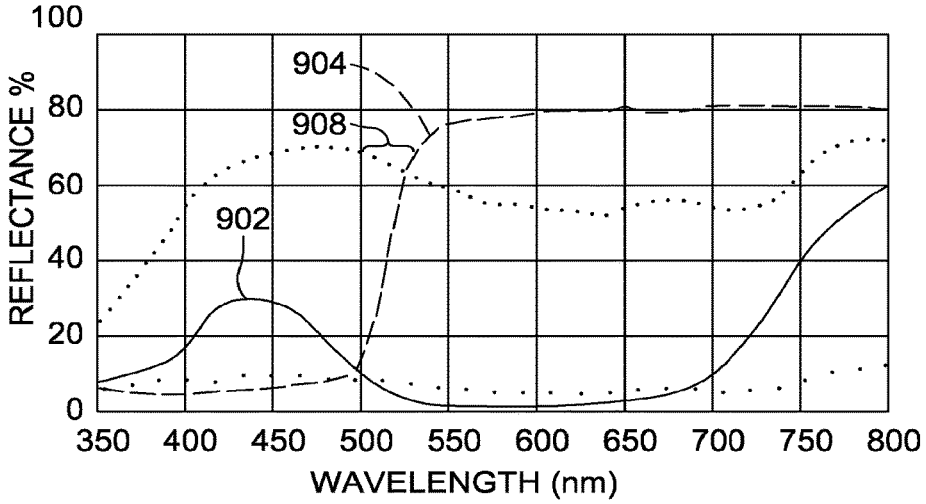
FIG. 9 illustrates a further example of reflectances of zones on a garment in accordance with the present invention.
Figure 10:
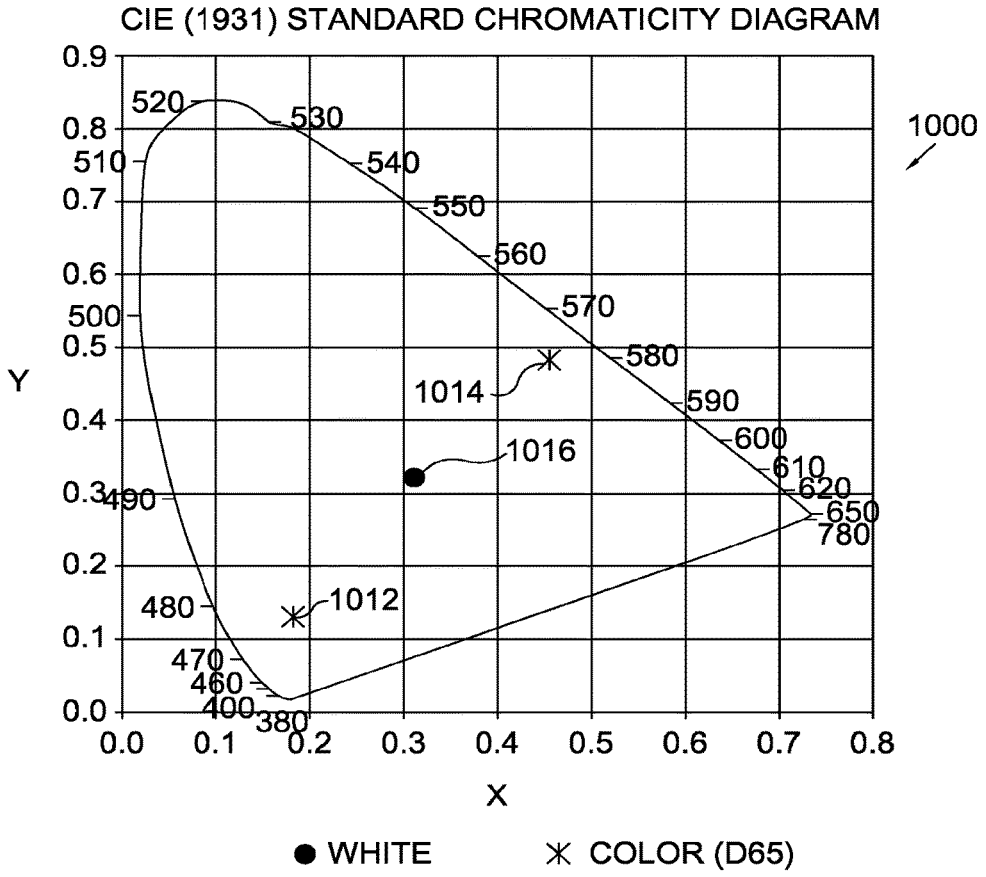
FIG. 10 illustrates a further example of CIE coordinates of zones of a garment in accordance with the present invention as illuminated by bright sunlight.
Figure 11:
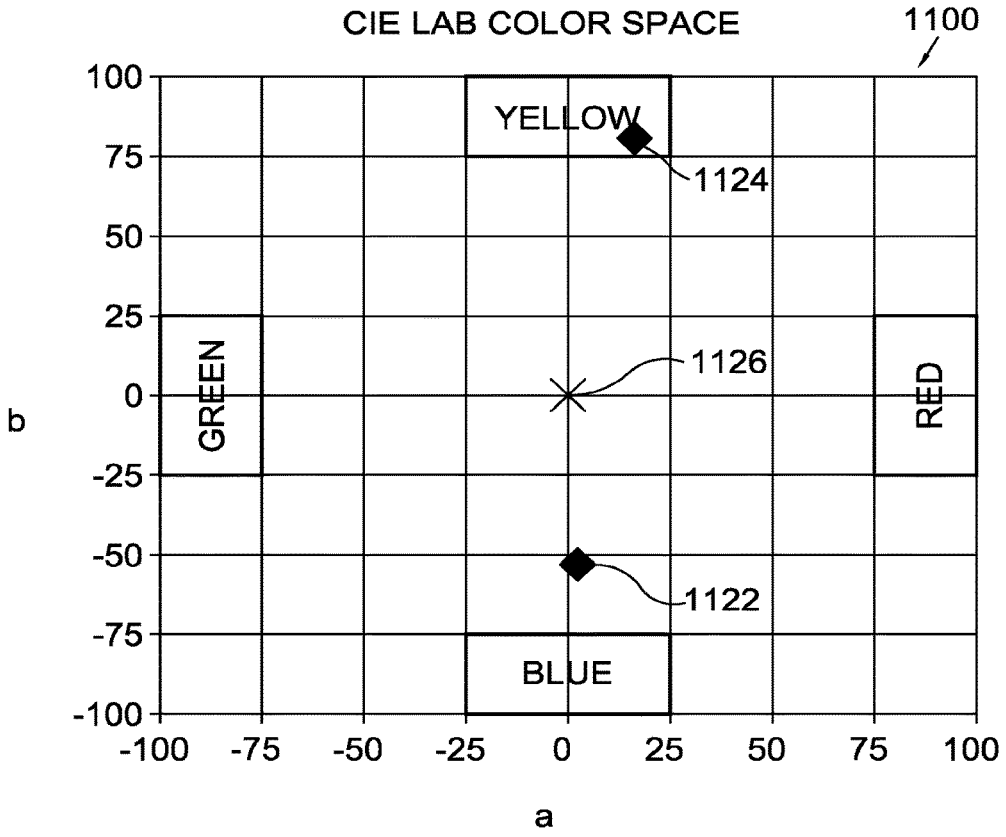
FIG. 11 illustrates example CIE L-a-b color coordinates of zones of a garment in accordance with the present invention associated with the color coordinates of FIG. 10.

A representative selection of visibility-enhancing coloration based on these additional considerations is illustrated in FIGS. 9-11. Referring to FIG. 9, a first zone reflectance 902 and a second zone reflectance 904 are selected that appear blue (or, alternatively, purple) and yellow, respectively. The reflectance curves 902, 904 are configured so that a spectral window 908 is defined in which the first zone and/or the second zone of a uniform in accordance with the present invention have reflectances that are reduced. Typically such reduced reflectances are less than about 50%, 25%, or 10%. As shown in FIG. 9, the spectral window 908 is located in a spectral region associated with green to enhance the appearance of the uniform on a typical green (grass) soccer pitch. CIE X-Y coordinate locations 1012, 1014 associated with the graphic reflectance and the casing reflectance, respectively, as illuminated in sunlight illumination are shown in a CIE standard chromaticity diagram 1010 in FIG. 10. For reference, a location 1016 of a standard white illuminant (similar to sunlight) is also shown. The CIE Z-coordinate that is associated with total reflectance or luminance is not shown on the chromaticity diagram 1010. The locations 1012, 1014 are widely separated and are opposite with respect to the location 1016. CIE L-a-b color coordinates associated with the reflectances 902, 904 are shown in FIG. 11 as locations 1122, 1124, respectively. The locations 1122, 1124 are widely separated and opposite with respect to a location 1126 associated with white illumination. A luminance coordinate is not shown. Color contrast can be associated with a distance between the locations 1122, 1124 on the L-a-b space representation, and total color difference associated with a total distance between the locations 1122, 1124 including differences associated with L-a-b color space L-coordinates.

Color coordinates (x-y-z and L-a-b) based on the spectral reflectances of FIG. 9 are listed in Table 2. The CIE dominant wavelengths for the first zone and the second zone are approximately 465 nm (blue) and 575 nm (yellow), respectively. However, the blue first zone may be replaced with a zone having a shorter dominant wavelength (i.e., purple) without departing from the scope of the present invention. Luminance contrast is about 93% and color difference (CD) is about 134. Total color difference (TCD) is about 147.

TABLE 2

Color coordinates associated with the spectral reflectances of FIG. 9.

| Color Coordinates | FIRST ZONE (Blue) | SECOND ZONE (Yellow) |
|---|---|---|
| x | 0.1859 | 0.4559 |
| Y | 0.1127 | 0.4771 |
| z | 0.7014 | 0.0670 |
| L | 24.78 | 84.03 |
| a | 0.41 | 17.11 |
| b | −52.29 | 80.63 |

Figure 12:
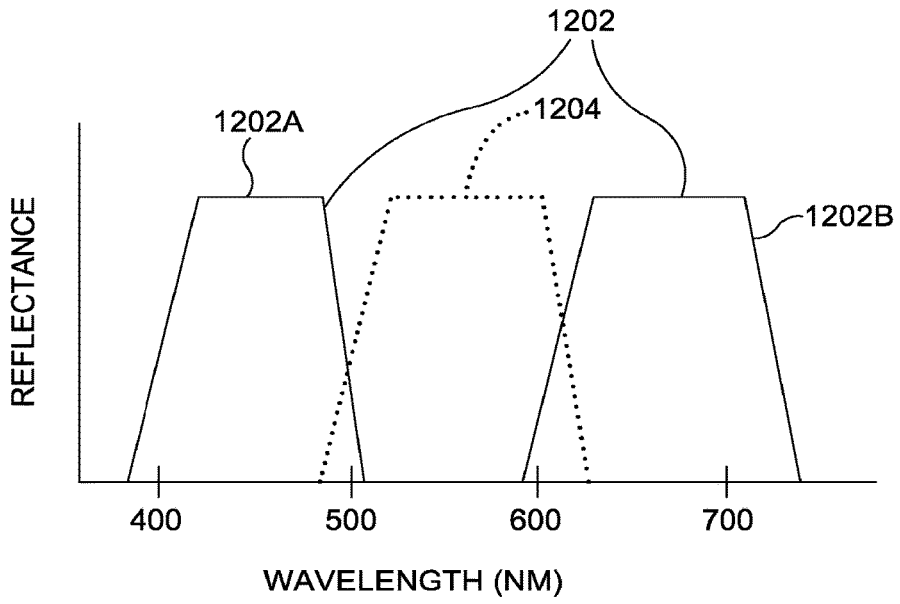
FIGS. 12-14 illustrate graphs of reflectance as a function of wavelength for additional example zones of garments in accordance with the present invention.
Figure 13:
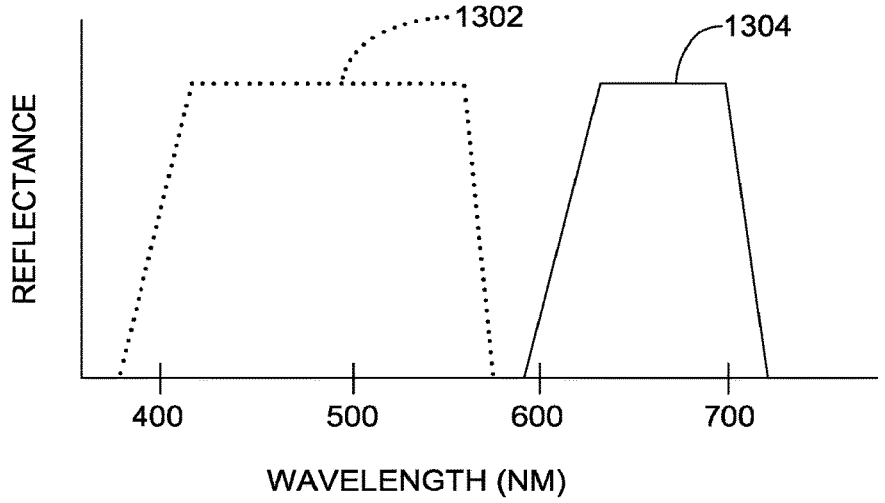
Figure 14:
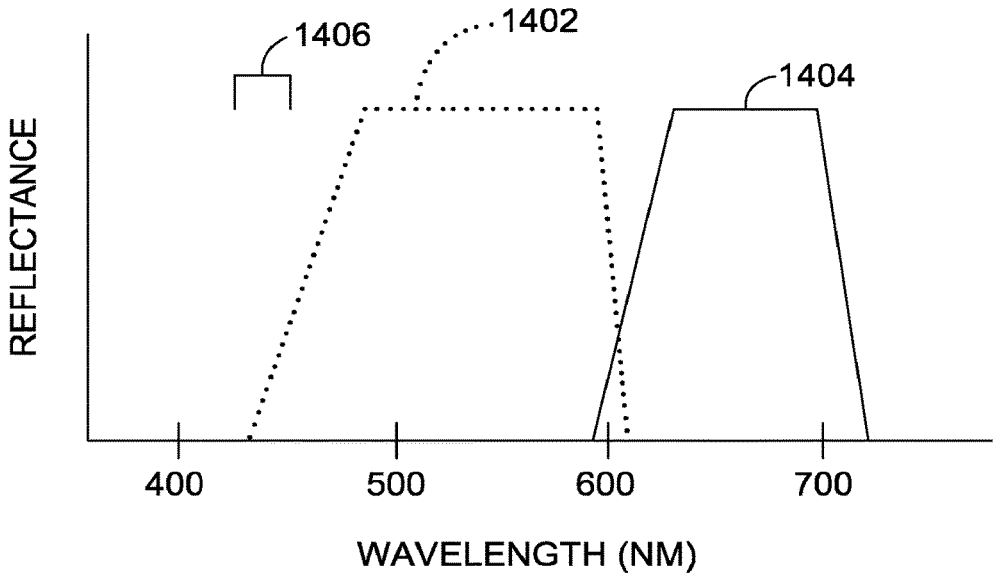

Additional representative examples complementary spectral reflectances are illustrated in FIGS. 12-14. FIG. 12 illustrates spectral reflectances 1202, 1204 associated with magenta and green, respectively. The reflectance 1202 includes portions 1202A, 1202B associated with substantial reflectance values in blue and red wavelength ranges, respectively. Spectral reflectances such as the reflectances 1202, 1204 can be used to enhance visibility. FIG. 13 illustrates spectral reflectances 1302, 1304 associated with cyan and red, respectively. In this example, the spectral reflectances 1302, 1304 do not overlap in a spectral window at about 580 nm. This spectral window can be associated with a background such as a playing surface, or can be associated with spectral characteristics of selected coloring materials. Spectral reflectances such as the reflectances 1302, 1304 can also be used to enhance visibility. Additional suitable reflectances 1401, 1404 associated with blue and yellow, respectively, are shown in FIG. 14. The reflectances 1402, 1404 lack appreciable reflectivity at wavelengths less than about 450 nm and therefore appropriate for defining colors on a ball to be used against a blue background, although such colors can be used with other backgrounds as well. As used herein, appreciable reflectivity refers to reflectivities greater than about 20%, 50%, or 75%.

Garment or uniform colors for zones can be selected to be substantially complementary or "opposing" as shown on a CIE plot. In some color representations, equal separations as graphed do not correspond to equal or even approximately equal perceived color differences. For example, so-called MacAdam ellipses of varying sizes and eccentricities can be used to characterize "just noticeable differences" (JND) in perceived colors as a function of coordinate location on the standard CIE chromaticity diagram. Representative methods for selecting enhanced visibility color combinations can be described with reference to FIG. 15. For convenience, a length of a chromatic blend line 1505 connecting locations 1502, 1504 associated with selected enhanced visibility colors and extending to a CIE curve boundary 1507 can be referred to as a chromatic blend limit (CBL). The CBL is associated with an available color space. Colors can be selected so that the corresponding separations on a CIE graph are greater than about 90%, 75%, or 50% of the CBL.

Figure 15:
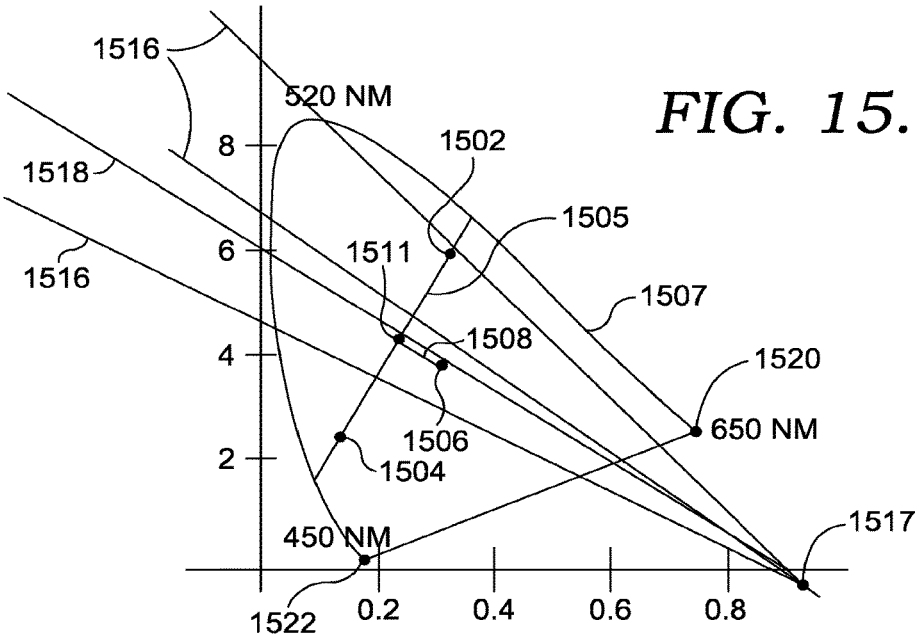
FIG. 15 illustrates an example CIE chromaticity curve illustrating selection of colors for zones of a garment in accordance with the present invention.

In addition to selecting colors having a predetermined CIE color space separation, colors are generally selected to be substantially opposite with respect to a color space location 1506 perpendicular to the chromatic blend line 1505 is less than about 50%, 25%, 15%, or 10% of the CBL. In addition, selected colors on the chromatic blend line 705 are on opposite sides of an intersection 1511 of the chromatic blend line 1505 and the line 1508. Enhanced-visibility color sets of two or more colors can be similarly selected using other color space representations as well, and the representation of FIG. 15 is only one convenient representation.

Colors and combinations that are appropriate even for so-called color deficient individuals (commonly known as "color blind" individuals) can be similarly selected. Referring further to FIG. 15, a series of color confusion lines 1516 associated with colors that are typically confused by individuals exhibiting deuteranopia or deuteranomaly extend from a deutan origin 1517. Color combinations along the lines 1516 are preferably avoided for such individuals. As is apparent, colors associated with the locations 1502, 1504 are well suited for such individuals as the chromatic mixing line 1505 connecting these points is approximately perpendicular to a deutan confusion line 1518 extending through the white point 1506. Such a confusion line can be referred to as a central confusion line so that the deutan confusion line 1518 can be referred to as a deutan central confusion line. Color confusion is generally avoided with chromatic blend lines are substantially perpendicular to a central confusion line, this is, that intersect central confusion lines at angles greater than 60 degrees, greater than 70 degrees, greater than 75 degrees, or greater than 80 degrees. In some examples, the angle of intersection is at least 85 degrees. In some examples, the angle of intersection is at least 85 degrees. While deutan (red-green color deficiency) is the most common form of color deficiency and is therefore desirably compensated in color selection, additional forms of color deficiency such as protan (red-green) or tritan (yellow-blue) color deficiency can be compensated using lines of confusion that originate from a protan origin 1520 or a tritan origin 1522, respectively.

Selected color coordinates can serve as a guide in dye or pigment selection or in selecting graphics for application onto a garment or uniform, and actual garment or uniform colors can differ. For example, dyes that are satisfactory with respect to durability, cost, fading, or other factors may be unavailable. In addition, enhanced-visibility colors can be modified for aesthetic reasons to, for example, coordinate with traditional team colors, or for other reasons. In some examples, actual colors deviate from associated target color coordinates to trade-off color vision correction, luminance contrast, or other design goals. Fluorescent agents can also be included to enhance overall ball luminance as well as to provide additional luminance at selected wavelengths.

Figure 16:
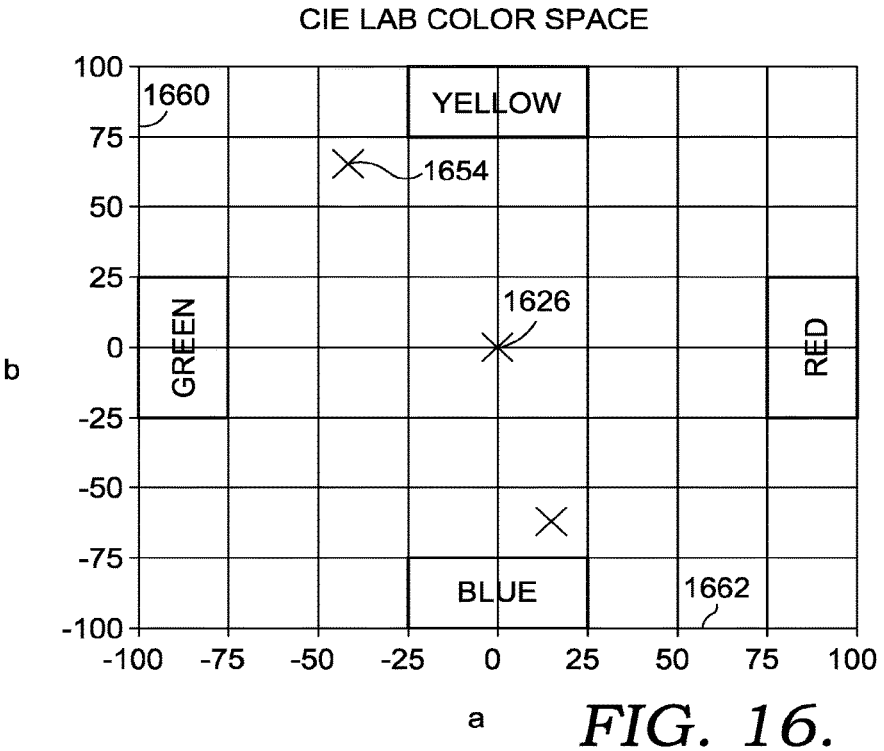
FIG. 16 illustrates an example CIE L-a-b color space for selection of zones of a garment in accordance with the present invention.

CIE L-a-b coordinates can also be used in enhanced-visibility color (EVC) selection. Referring to FIG. 16, locations 1632, 1654 can be associated with selected EVCs. For example, suitable EVC pairs such as the pair associated with the locations 1652, 1654 are defined by L-a-b locations that are separated along a b-axis 1660 by at least 50, 75, 100, 125, or 150 units. In some examples, at one location is associated with a negative b-value and one location is associated with a positive b-value. In other examples, locations are separated along an a-axis 1662 by at least 50, 75, 100, 125, or 150 units, and in particular examples, one location is associated with a negative a-value and one location is associated with a positive a-value. In other examples, a color difference (CD) is selected that is greater than about 50, 75, 100, 125, or 150 units without regard for a particular axis.

Figure 17:
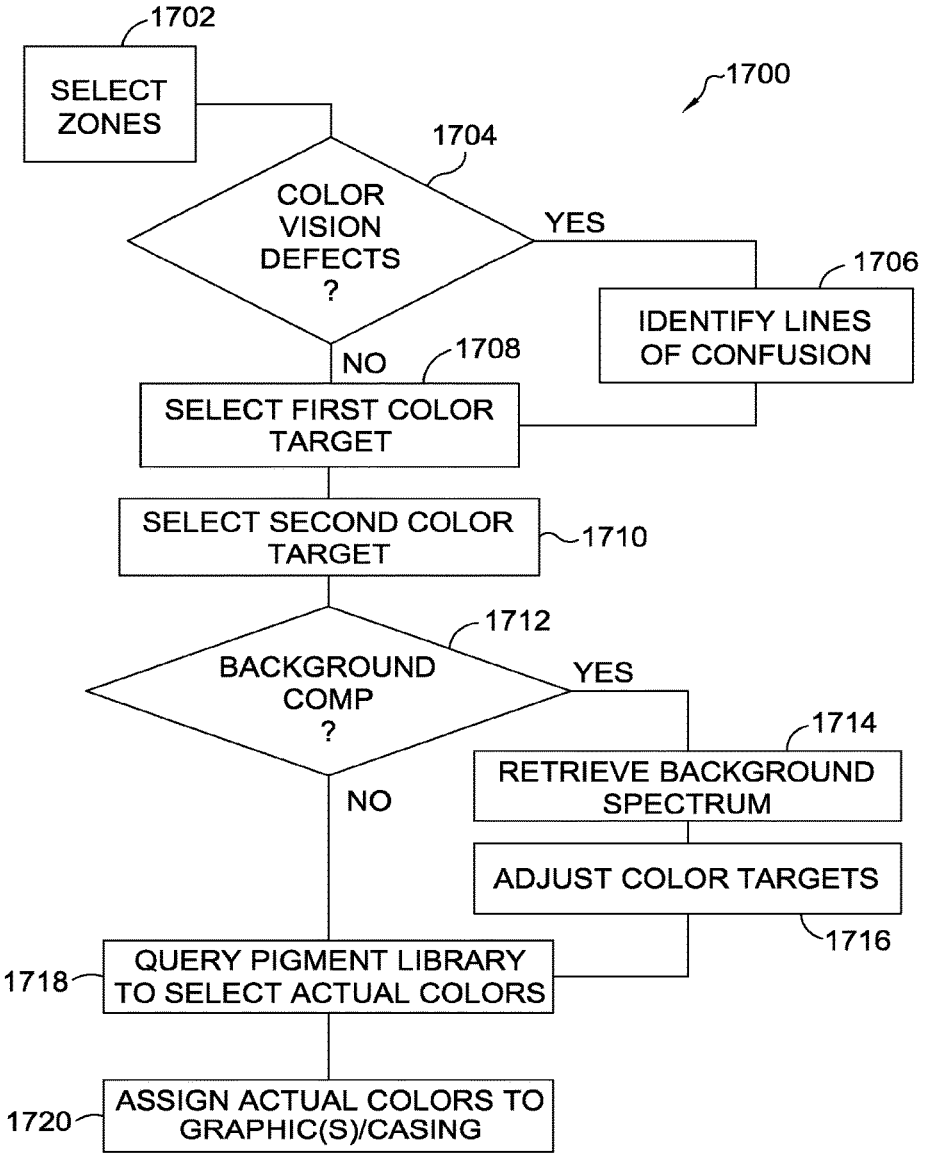
FIG. 17 illustrates a method of selecting zone colors to accommodate color deficient vision.

With reference to FIG. 17, a representative method 1700 for positioning and coloring zones on a garment is illustrated. A first zone and a second zone (or more) may be positioned and/or sized on a garment in a step 1702. In a step 1704, a determination of whether color selection is to consider color vision defects is made. If, for example, avoidance of colors confused by some individuals due to a color deficiency is desired, lines of confusion can be identified in a step 1706 so that such colors can be identified or avoided. In other examples, colors and color combinations inappropriate for color deficient individuals can be identified in other ways. In steps 1708, 1710, first and second target colors are selected based on, for example, CIE coordinates or using another method. In a step 1712, a determination of whether a background such as grass, sky, clouds, or other background is to be considered is made. If so, a background spectrum is retrieved from a database in step 1714, and the first and second target colors are modified based on the background spectrum in a step 1716. A pigment library is queried in a step 1718, and pigments are assigned to, for example, a casing and a graphic in a step 1720. Alternatively, colors can be selected based on PANTONE colors.

Garments and uniforms in accordance with the present invention may utilize one or more of various approaches to creating flicker effect to better assist teammates in evaluating the location, orientation, speed, acceleration, etc. of the wearer. While various other approaches to creating flicker in accordance with the present invention may be utilized in constructing garments or uniforms, three broad examples are illustrated herein.

Figure 18:
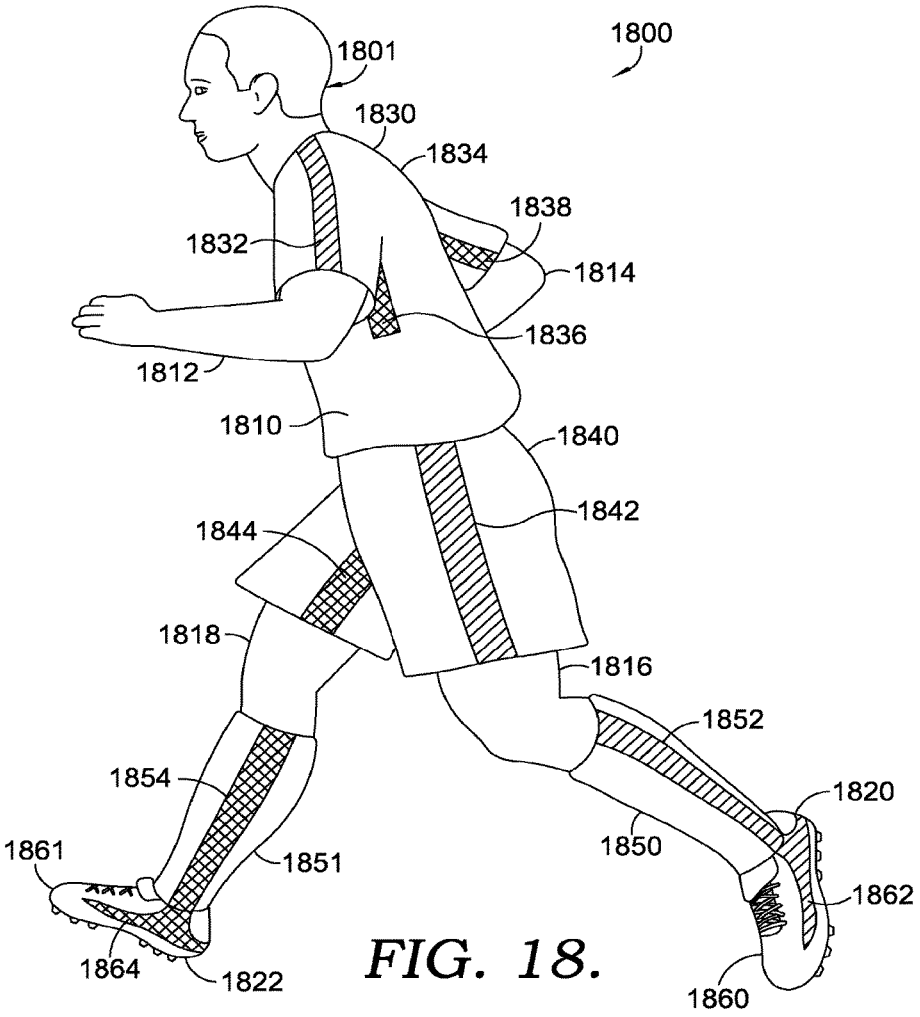
FIG. 18 illustrates a sports uniform in accordance with the present invention having visibility zones and flicker zones.

Referring now to FIG. 18, a soccer player wearing a sports uniform 1800 is illustrated. Uniform 1800 may comprise a shirt 1830, shorts 1840, socks 1850, 1851, and shoes 1860, 1861. Shirt 1830 may possess a first visibility zone 1832 on the shoulder and upper arm when worn, substantially as described above with regard to FIG. 1. Similarly, shorts 1840 may have a first visibility zone 1842 extending from the hip down the upper leg such as described above in the example of FIG. 1. Similarly, socks 1850, 1851 may have a first visibility zone 1852 (illustrated only with regard to first sock 1850) extending from about the knee to the ankle when worn, such as illustrated above with regard to the example of FIG. 1. Likewise, shoes 1820, 1821 may have a first visibility zone 1862 extending from approximately the heel to the toe when worn (illustrated only for first shoe 1820) such as illustrated in the example of FIG. 1 above. While visibility zones 1832, 1842, 1852, 1862 may be advantageous to enhance the visibility of a wearer to teammates during competition, all or some of the zones may be omitted while a garment or uniform in accordance with the present invention creates a flicker effect, as shall be described below.

In the example illustrated in FIG. 18, one or more of garments of uniform 1800 may contribute to the creation of a flicker effect perceivable by the wearer's teammates when flicker zones are obscured and revealed in alternating fashion during movement by the wearer. For example, shirt 1830 may have a flicker zone 1836 located on shirt 1830 such that when worn flicker zone 1836 may be obscured by the arm 1812 of wearer and/or the sleeve of shirt 1830 and revealed when arm 1812 is lifted or swung away from the side of wearer. While only one flicker zone 1836 is illustrated in the example shirt 1830, a corresponding flicker zone may be located on the opposite side of shirt 1830 to be viewed from the opposing side of the uniform 1800. Similarly, shorts 1840 may have a flicker zone 1844 located on the inner portion of the leg 1818 that will be alternately obscured and revealed when the nearer leg 1816 in FIG. 18 is moved back and forth for example during running. In a similar fashion, sock 1851 may have a flicker zone 1854 and shoe 1861 may have a flicker zone 1864, which may operate in a similar fashion to that described with regard to shorts 1840. With regard to shorts 1840 socks 1850, 1851 and shoes 1860, 1861, FIG. 8 illustrates a profile of the left side of a wearer of uniform 1800, resulting in only the flicker zones 1844, 1854, 1864 on the right side of the uniform 1800 when worn being illustrated. Of course, similar flicker zones (not illustrated) may be applied to the left legs of shorts 1840, the left sock 1850, and the left foot 1860, to create a flicker effect for teammates viewing the wearer of uniform 1800 from his or her right side as well.

A garment or uniform in accordance with the present invention may possess fewer or greater numbers of flicker zones than those illustrated in FIG. 18. Flicker zones on garments or uniforms in accordance with the present invention may possess sets of visual properties that contrast with the garment around the zone, the garment and/or body part of the wearer that may obscure the flicker zone, and/or the visual background, such as grass. Flicker zones on garments or uniforms in accordance with the present invention may further contrast, if desired, with other zones on a garment such as first visibility zones 1832, 1842, 1852, 1862. Contrast for flicker zones may be created as described above, for example by selection of colors widely spaced in color space and/or CIE (1931) Standard Chromaticity Diagrams, by manipulating luminance, by creating flicker zones to be substantially non-reflective in a spectral window associated with the visual background and/or other components of a garment or uniform, etc.

Figure 19:
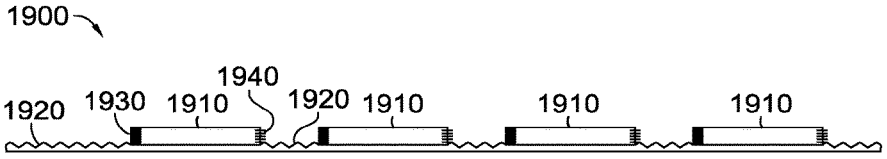
FIG. 19 illustrates a contoured surface that may form a flicker zone in accordance with the present invention.

Referring now to FIG. 19, an example portion of a flicker zone 1900 utilizing texture to create flicker is illustrated. By creating a surface with protrusions 1910 different portions of flicker zone 1900 may come in to view when the wearer of a garment or uniform having flicker zone 1900 appropriately placed thereon may result in different physical portions of flicker zone 1900 being viewable by teammates as the wearer moves. Protrusions 1910 may take on any shape, such as domed, curved, pointed, etc. Further, protrusions 1910 may take on different shapes within a single flicker zone. Optionally, different portions of the surface of flicker zone 1900 may possess different visual properties to further enhance the flicker effect created by movement. For example, the surface of flicker zone 1900 between protrusions 1910 may possess a first visual property or properties. Meanwhile, a first side face 1930 of protrusions may possess a second visual property or properties, a second side face 1940 of protrusions may possess a third visual property or properties, and the face 1950 of protrusions 1910 may possess yet a fourth visual property or properties. The first, second, third, fourth, etc. visual properties may be selected to contrast with one another, the other portions of the garment or uniform in accordance with the present invention, the visual background, etc., such as described above. The use of texture for a flicker zone 1900 as illustrated in the example of FIG. 19 may permit an additional flicker effect for flicker zones such as illustrated in the example of FIG. 18, but may also be utilized in garments or uniforms such as the example illustrated in FIG. 1 to create a flicker effect within the visibility zones themselves. For example, a flicker zone such as the flicker zone 1900 illustrated in the example of FIG. 19 may be used to create first zone 111 of jersey 110 in the example illustrated in FIG. 1, as well as any other zone desired.

The texture of flicker zone 1900 may be created in a variety of manners. For example, a garment may be knitted, and the knitting processes used may varied to create dimensional structures in the textile to form flicker zone 1900. If different visual properties are desired for different portions of flicker zone 1900 in the knitting example, different yarn types in the knit may be brought to the surface at different locations. Similarly, weaving techniques, such as Jacquard knitting, may be used to weave three dimensional structures onto a textile for use in creating a garment or uniform in accordance with the present invention. A further example of a way to create a textured flicker zone such as flicker zone 1900 is the use of thermal plastics, adhesive tapes, and the like that may be molded before or during application to a textile or garment. Such materials may be molded before or after application to a textile or garment. Additionally and/or alternatively, moldable and/or heat reactive yarns may be incorporated into a textile and heated and/or molded during the creation of a garment in accordance with the present invention. Yet a further example of a way to form textured flicker zone such as flicker zone 1900 is the use of heat transfers, decals or similar patches that may be independently constructed to possess desired visual properties and then may be affixed to a garment or uniform at a desired location to provide the desired visual properties.

Figure 20:
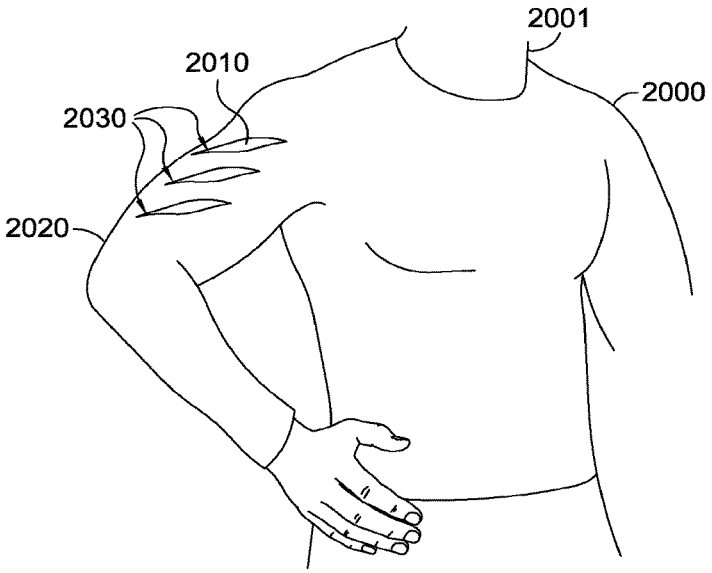
FIGS. 20-21 illustrate flicker zones created using multiple layers of a garment.
Figure 21:
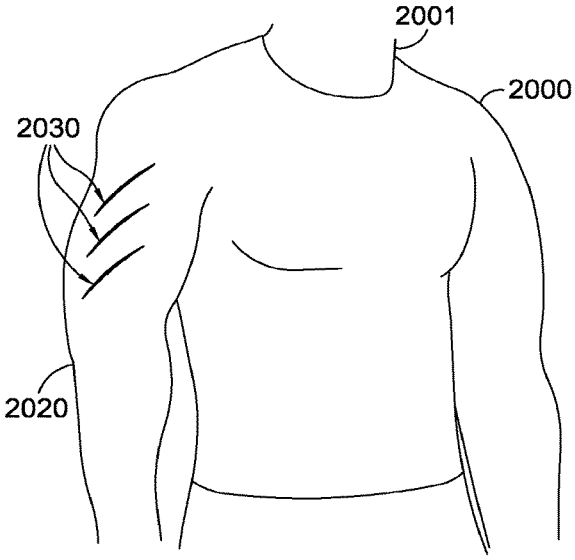

Referring now to FIGS. 20 and 21, a further example of an approach to creating flicker zones is illustrated. In the example of FIGS. 20 and 21, a multi-layered garment 2000 or uniform may have at least an inner layer 2010 having a first set of visual properties and an outer layer 2020 having a second set of visual properties. The first set of visual properties of the inner layer 2010 and second set of visual properties of the outer layer 2020 may contrast with one another and/or the visual background such as described herein. As described below, the inner layer and outer layer of a garment or uniform in accordance with the present invention may be formed to provide moisture management capabilities for the comfort and enhanced performance of the wearer. Holes or openings 2030 may be formed in the outer layer 2020 to permit the viewing of the contrasting inner layer 2010 as the wearer 2001 moves and assumes various bodily positions, as is illustrated in FIG. 21. The opening of holes as illustrated in FIG. 20 may further facilitate the cooling and comfort of the wearer. As illustrated in FIG. 20, when the wearer moves or takes other positions the size of the hole and/or its location and orientation on the body of the wearer may vary, thereby creating a flicker effect to be viewed by teammates. In this fashion, a flicker zone may be created using a multi-layered garment to create the flicker zones by permitting viewing of differing layers of the garment. Of course, garments and uniforms in accordance with the present invention may utilize more than two layers. Holes may extend through a single or multiple layers depending upon the number of layers provided in the garment. Holes or openings in a layer may be formed during knitting or weaving, by dissolving dissolvable yarns, by kiting, by use of lasers or other devices, or any other means.

In addition to providing enhanced visibility to a wearer's teammates garments or uniforms in accordance with the present invention may provide moisture management capabilities. Moisture management is the ability of a fabric to transport sweat away from the body in order to keep the wearer dry and comfortable. Any moisture management technology, such as Nike's DRI-FIT technology, may be employed in conjunction with garments or uniforms in accordance with the present invention.

Another example of a moisture management technology suitable for use in garments or uniforms in accordance with the present invention is a denier differential mechanism. A denier differential mechanism utilizes morphological properties of fibers and textiles, to provide moisture management properties. Denier differential refers to yarn of different denier or thickness on the face versus the back of a textile. A moisture management fabric may be engineered with two sides: a facing layer and a back layer. Surface tension and capillary forces drive the moisture from the wearer's skin to the back layer. Moisture then moves from the back layer to the facing layer due to increased surface area of the facing layer. Due to the increased surface area of the facing layer, moisture may be spread out with greater surface area to evaporate.

Figure 22:
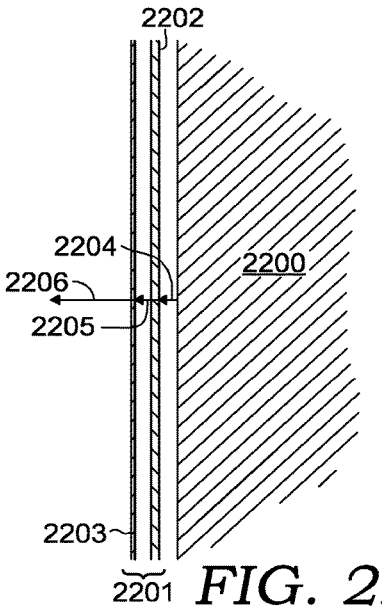
FIGS. 22-25 illustrate schematics of examples of denier differential fabrics with illustrative moisture paths that may be used in garments in accordance with the present invention.

Referring to FIG. 22, an example of a moisture management fabric is depicted. The moisture management fabric 2201 comprises two layers: a first fabric layer 2203 and a second fabric layer 2202. Additional aspects may include additional layers adjacent first or second fabric layer or both that may provide tailored levels of moisture management and support in a composite fabric. Both the first fabric layer 2203 and second fabric layer 2202 may be constructed of a yarn or thread.

The first fabric layer 2203 and the second fabric layer 2202 may be constructed separately, by knitting or weaving, and assembled to form the fabric. In another example, the layer 2203 and the second fabric layer 2202 may be constructed continuously, by knitting or weaving, to form a seamless fabric. The second fabric layer 2202 is the layer adjacent to the wearer's body 2000 and the first fabric layer 2203 is adjacent to the second fabric layer 2202. The wearer's body 2200 perspires and moisture may be adsorbed 2204 from the body 2200 surface to the first fabric layer 2203. The denier differential, which is discussed in greater detail below, between the first fabric layer 2203 and the second fabric layer 2202, can provide a difference in porosity and surface area wherein the first fabric layer 2203 has a greater surface area and smaller pores than the second fabric layer 2202. The smaller pores and greater surface area results in increased capillary force for aqueous solutions for the first fabric layer 2203 than the second fabric layer 2202. The denier differential produces wicking 2205 from the second fabric layer 2202 to the first fabric layer 2203. The moisture, once transported to the first fabric layer 2203, may be adsorbed to and spread out over the increased surface area of the first fabric layer 2203. The increased surface area of the first fabric layer 2203 can encourage moisture evaporation 2206 from the first fabric layer 2203. The moisture management fabric can thus transport moisture efficiently from the wearer 2200, to the second fabric layer 2202 to keep the wearer comfortable, and to the first fabric layer 2203 to promote evaporation from the fabric to keep the wearer dry.

Figure 23:
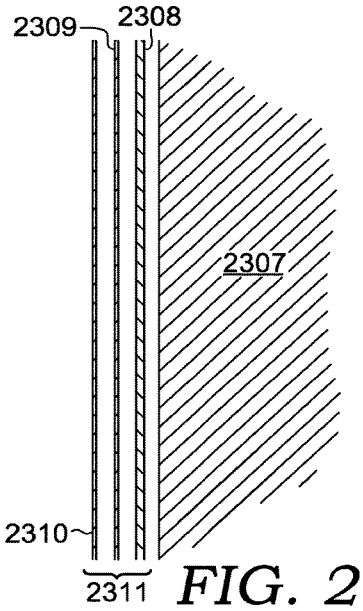
Figure 24:
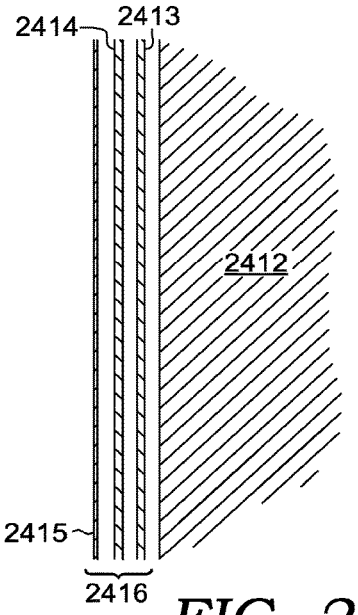
Figure 25:
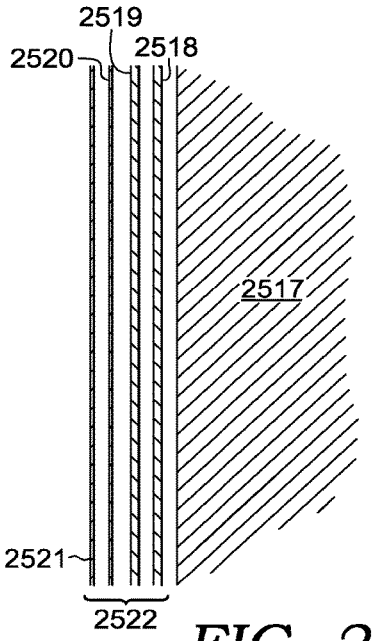

FIGS. 23-25 illustrate examples of a moisture management fabric with at least one additional fabric layer. FIG. 23 illustrates a third fabric layer 2309 disposed between the first fabric layer 2310 and the second fabric layer 2308. In this example of a moisture management fabric, the third fabric layer 2309 may be constructed by knitting or weaving a third yarn or thread. The first fabric layer may be constructed by knitting or weaving a first yarn and the second fabric layer may be constructed by knitting or weaving a second yarn. In FIG. 23, the third fabric layer 2309 may be constructed such that the porosity and surface area of the third fabric layer 2309 is greater than the porosity and surface area of the second fabric layer 2308. The third fabric layer 2309 may be constructed by knitting or weaving third yarn of a third denier per filament, which is comparable in size to or larger than the first yarn. The denier per filament of the third fabric layer 2309 may be greater than the denier per filament of the first fabric layer 2310 and less than the denier per filament of the second fabric layer 2308 such that a gradient of surface areas and porosities is provided. The first fabric layer and the third fabric layer may be knitted separately, double-knit, or plaited single-knit. The second fabric layer may be knitted separately. In another example, the third fabric layer and the second fabric layer may be knitted separately, double knit, or plaited single knit. The first fabric layer may be knitted separately. Fabrics used in garments in accordance with the present invention may also be woven, rather than knitted. Further, fabrics used in accordance with the present invention may be moldable to take on a desired shape or contour.

FIG. 24 illustrates a moisture management fabric 2416 having at least a third fabric layer 2414 which is an intermediate layer of the fabric disposed between the first fabric layer 2415 and the second fabric layer 2413. In one example of a moisture management fabric 2416, the third fabric layer 2414 may be constructed by knitting or weaving a third yarn or thread. The first fabric layer 2415 may be constructed by knitting or weaving a first yarn or thread; and the second fabric layer 2413 may be constructed by knitting or weaving a second yarn or thread. In FIG. 24, the third fabric layer 2414 may be constructed such that the porosity and surface area of the third fabric layer 2414 is less than the porosity and surface area of the first fabric layer 2415. The third fabric layer 2414 may be constructed by knitting or weaving a yarn or thread, which is comparable in size to or less than in size than yarn or thread of the second fabric layer 2413. The denier per filament of the third fabric layer 2414 may be greater than the denier per filament of the first fabric layer 2415 and less than the denier per filament of the second fabric layer 2413 such that a gradient of surface areas and porosities is provided. The first fabric layer 2415 and the third fabric layer 2414 may be knitted separately, double-knit, or plaited single-knit. The second fabric layer 2413 may be knitted separately. In another example, the third fabric layer 2414 and the second fabric layer 2413 may be knitted separately, double knit, or plaited single knit. The first fabric layer 2415 may be knitted separately.

FIG. 25 illustrates moisture management fabric 2522 having at least a third fabric layer 2520 and a fourth fabric layer 2519 each of which is an intermediate layer of the fabric disposed between the first fabric layer 2521 and the second fabric layer 2518. In one example of a moisture management fabric, the third fabric layer 2520 may be constructed by knitting or weaving a third yarn or thread. In one example of a moisture management fabric, the fourth fabric layer 2519 may be constructed by knitting or weaving a third yarn or thread. The first fabric layer 2521 may be constructed by knitting or weaving a first yarn or thread; and the second fabric layer 2518 may be constructed by knitting or weaving a second yarn or thread. In FIG. 25, the fabric 2522 may be constructed such that the porosity and surface area of the third fabric layer 2520 is less than the porosity and surface area of the first fabric layer 2521 and the porosity and surface area of the fourth fabric layer 2519 is greater than the porosity and surface area of the second fabric layer. In one example, the third fabric layer 2520 has a porosity and surface area between that of the fourth fabric layer 2519 and the first fabric layer 2521; and the fourth fabric layer 2519 has a porosity and surface area between that of the third fabric layer 2520 and the second fabric layer. The first fabric layer 2521, the second fabric layer 2518, the third fabric layer 2520, and the fourth fabric layer 2519 may be woven or knitted separately. Alternatively, adjacent layers, such as the first fabric layer 2521 and the third fabric layer 2520, the third fabric layer 2520 and the fourth fabric layer 2519, the fourth fabric layer 2519 and the second fabric layer 2518 may be double-knit or plaited single-knit and combined with the remaining single, double-knit, or plaited single-knit layers.

Any combination of the examples illustrated in FIGS. 22-25 may be employed to achieve a moisture management fabric. Examples including a plurality of fabric layers may provide a gradient of surface areas and porosities for a composite fabric. In another example, additional fabric layers adjacent to the first fabric layer and second fabric layer may have similar porosity and surface area as the contacting first fabric layer and second fabric layer. In another example, a plurality of the above described fabric layers may provide a moisture management fabric with specific moisture management properties.

Figure 26:
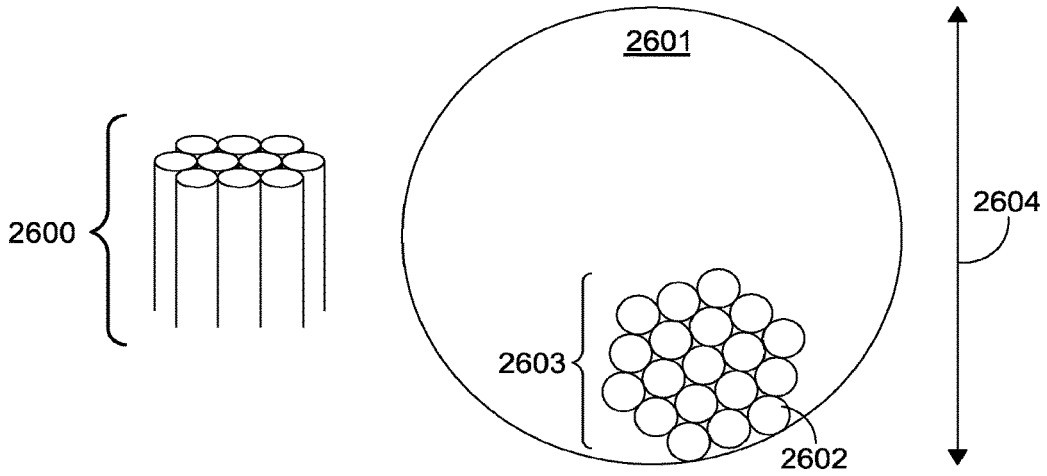
FIGS. 26-27 illustrate aspects of yarns comprising denier differential textiles that may be used in garments in accordance with the present invention.

Examples of the yarns that may be employed in the construction of the denier differential fabric are monofilament or multifilament yarns of any known synthetic or natural fiber. The yarn may be a filament yarn or a spun yarn. A exemplary yarn may be a bundle of individual filaments. The total yarn size may be measured in denier, for example 9,0000 m of an exemplary yarn weighs X g has a size of X denier. The denier per filament is calculated by dividing the total yarn size (X denier) by the total number of filaments. In FIG. 26, an exemplary first yarn 2606 may be used to construct a moisture management garment. Yarns may be composed of nylon or polyester and the second, for example yarns may be microfibers. Moreover, surface treatment or additional modification may be employed to impart a greater relative hydrophobicity to the macrofiber or a great relative hydrophillicity to a yarn.

In one example, the first fabric layer may be knitted or woven of a first yarn of a first denier per filament of less than or equal to 1.04 denier per filament, preferably 0.50 to 1.04 denier per filament. The second fabric layer may be knitted or woven of a second yarn of a second denier per filament of greater than or equal to 1.04 denier per filament, preferably 1.04 to 3.50. The denier differential between the first yarn and the second yarn may be at least 0.54. The third fabric layer may be knitted or woven of a third yarn of a third denier per filament. In one example, the third denier per filament is less than or equal to 1.04 denier per filament, preferably 0.50 to 1.04 denier per filament. In another example, the third denier per filament is greater than or equal to 1.04, preferably 1.04 to 3.50. The third denier per filament may be a value less than the second denier per filament but greater than the first denier per filament. In another example, the fourth fabric layer may be knitted or woven of a fourth yarn of a fourth denier per filament. The fourth denier per filament may be less than or equal to 1.04 denier per filament, preferably 0.50 to 1.04 denier per filament. Alternatively, the fourth denier per filament may be greater than or equal to 1.04, preferably 1.04 to 3.50. The fourth denier per filament may be a value less than the second denier per filament but greater than the first denier per filament.

Figure 27:
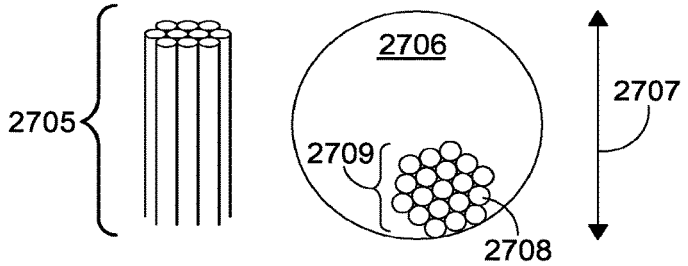

In FIG. 26-27 an example of a moisture management garment is depicted. The moisture management garment 2601 comprises two layers: a first fabric layer 2603 and a second fabric layer 2602. Additional examples may include additional layers adjacent first or second fabric layer or both that may provide tailored levels of moisture management and any desired support in a composite fabric. Both the first fabric layer 2603 and second fabric layer 2602 may be constructed of a yarn or thread. The first fabric layer 2603 may be constructed of a first yarn having a denier per filament of less than or equal to 1.04. The second fabric layer 2602 may be constructed of a second yarn or thread of greater than or equal to 1.04. The denier differential between the first yarn and the second yarn may be at least 0.54.

The first fabric layer 2603 and the second fabric layer 2602 may be constructed separately, by knitting or weaving, and assembled to form the fabric. In another example, the layer 2603 and the second fabric layer 2602 may be constructed continuously, by knitting or weaving, to form a seamless fabric. The second fabric layer 2602 is the layer adjacent to the wearer's body 2600 and the first fabric layer 2603 is adjacent to the second fabric layer 2602. The wearer's body 2600 perspires and moisture may be adsorbed 2604 from the body 2600 surface to the first fabric layer 2603. The denier differential between the first fabric layer 2603 and the second fabric layer 2602, can provide a difference in porosity and surface area wherein the first fabric layer 2603 has a greater surface area and smaller pores than the second fabric layer 2602. The smaller pores and greater surface area results in increased capillary force for aqueous solutions for the first fabric layer 2603 than the second fabric layer 2602. The denier differential produces wicking 2605 from the second fabric layer 2602 to the first fabric layer 2603. The moisture, once transported to the first fabric layer 2603, may be adsorbed to and spread out over the increased surface area of the first fabric layer 2603. The increased surface area of the first fabric layer 2603 can encourage moisture evaporation 2606 from the first fabric layer 2603. The moisture management garment 2601, which may be constructed of a moisture management fabric described above, can thus transport moisture efficiently from the wearer 2600, to the second fabric layer 2602 to keep the wearer comfortable, and to the first fabric layer 2603 to promote evaporation from the garment to keep the wearer dry.

A more detailed description of denier differential garments that may be used in accordance with the present invention may be found in U.S. patent application Ser. No. 12/987,235, filed Jan. 10, 2011, entitled Moisture Management Support Garment With A Denier Differential Mechanism, which is incorporated by reference. A moisture management garment may also/additionally provide zones by incorporating aerographic yarn compositions and zoning. Aerographics generally refers to a method of using two yarn compositions: one that may be dissolvable in a given solvent and one that may not be dissolvable in the solvent. Dissolution of the dissolvable yarn may be confined to specific zones and provides a way to remove a portion of the fabric to increase air flow and porosity of the fabric. By incorporating a dissolvable yarn into a garment in accordance with the present invention, such as 9 denier differential fabric, certain areas of an exemplary garment may be given different visual properties. Further, aerographic zoning may provide more ventilation for some zones while other areas or zones of the garment may be selected to promote skin-side dryness by moving moisture away from skin.

Figure 28:
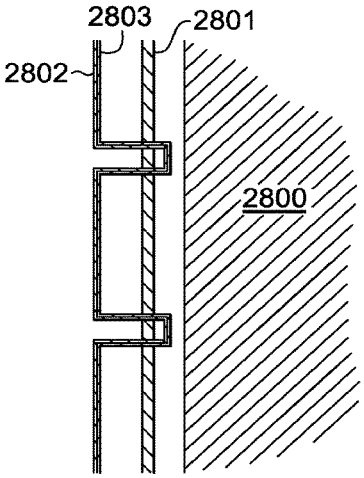
FIGS. 28-30 illustrate zoning of a garment in accordance with the present invention using aerographics.

Referring to FIG. 28, an exemplary zoned moisture management garment with at least one zone is illustrated. The zoned moisture management garment fabric may include two layers, which may be woven or knit, including circular double-knit or circular, plaited single-knit or any known warp knit. Any appropriate pattern or method of weaving or knitting may be employed. The first fabric layer may include a first non-dissolvable yarn 2802 and a first dissolvable yarn 2803. Generally the first non-dissolvable yarn 2802 may be a microfiber and may have a denier per filament of less than or equal to about 1.04 denier per filament, such as about 0.50 to about 1.04 denier per filament. The first dissolvable yarn 2803 may be a microfiber and may have a denier per filament of less than or equal to about 1.04 denier per filament, for example about 0.50 to about 1.04 denier per filament. The first dissolvable yarn 2803 and the first non-dissolvable yarn 2802 may have similar or differing thickness. The first non-dissolvable yarn 2802 may be any synthetic, including polyester, and the first dissolvable yarn 2803 may be any yarn which will dissolve under conditions which will not affect the first non-dissolvable yarn 2902 or the second non-dissolvable yarn 2801, such as rayon, cotton, Lyocell, other cellulosic feedstock, and/or dissolvable synthetic fiber, such as dissolvable polyester. Also, the first dissolvable yarn 2803 may be up to 40% of the overall weight or volume of the fabric, for example 30% of the total weight or volume of the fabric.

The second fabric layer may include a second non-dissolvable yarn 2801, which may be a macrofiber and have a second denier per filament of greater than or equal to about 1.04 denier per filament, such as about 1.04 to about 3.50. The second non-dissolvable yarn may be any synthetic, such as polyester. The denier differential between the first non-dissolvable yarn 2802 and the second non-dissolvable yarn 2801 may be at least about 0.54.

Figure 29:
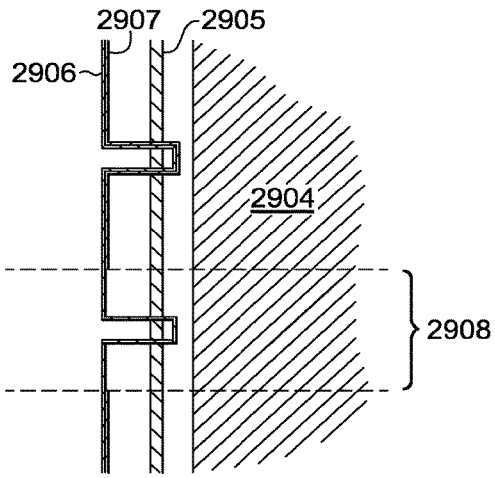

An exemplary zoned moisture management garment having at least one dissolved zone 2908 is shown in FIG. 29. The second fabric layer may include the second non-dissolvable yarn 2905 with a denier differential of about 0.54 over the first non-dissolvable yarn 2906 of the first fabric layer and may have a denier differential of about 0.54 over the first dissolvable yarn 2907 of the first fabric layer. It may be desired to provide an exemplary moisture management garment that may have different porosity and ventilation in specific zones of the garment. These zones may be determined by the sweat profile and contact profile of the wearer and are described below.

In FIG. 29, a zone 2908 is illustrated in an exemplary garment where a portion of the first dissolvable yarn 2907 is removed. These zones may be removed for example, by printing a paste or gel which is capable of dissolving the first dissolvable yarn 2907. As the paste or gel may be printed, the zones may be applied as logos, patterns, or other graphics. In one instance, the first non-dissolvable yarn may be a synthetic yarn, such as polyester yarn and the first dissolvable yarn may be a distinct cellulosic yarn, such as rayon yarn. The garment may be screen printed with the paste which dissolves only the dissolvable yarn content leaving behind the non-dissolvable yarns which form a mesh fabric structure. The mesh area may have greatly increased porosity relative to the undissolved portions of the fabric, which increases the air permeability of the fabric. This approach may reduce the fabric weight and may avoid bulky seams resulting from traditional piecing together of fabrics of different meshes to produce a zoned garment. The screen printing approach also provides a route for creating patterned or graphic meshes.

Figure 30:
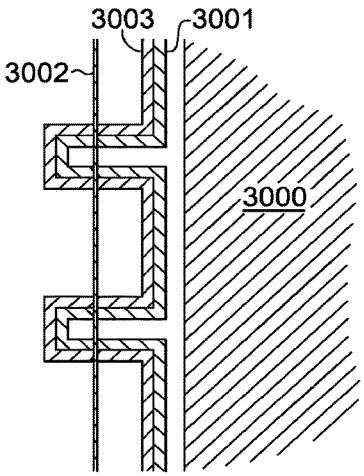

Another exemplary zoned moisture management garment is illustrated in FIG. 30. The garment may comprise a first fabric layer 3002 having a first non-dissolvable yarn 3002. The garment may also comprise a second fabric layer 3003/3001 having a second non-dissolvable yarn 3001 and a first dissolvable yarn 3003. Fabric layers of the garment may be circular double-knit or circular, plaited single-knit or any known warp knit. In another example, fabric layers of the garment may be woven. The first non-dissolvable yarn 3002 be a microfiber and may have a denier per filament of less than or equal to about 1.04 denier per filament, such as about 0.50 to about 1.04 denier per filament. The second fabric layer may include a second non-dissolvable yarn 3001, which may be a macrofiber and have a second denier per filament of greater than or equal to about 1.04 denier per filament, such as about 1.04 to about 3.50, and a first dissolvable yarn 3003. The first dissolvable yarn 3003 may have a denier per filament of greater than or equal to about 1.04 denier per filament, such as about 1.04 to about 3.50. The first dissolvable yarn 3003 and the second non-dissolvable yarn 3001 may have similar or differing thickness. The first dissolvable yarn 3003 may be up to 40% of the total weight or volume of the fabric of the garment, such as 30% or between about 10% and about 40%. The second non-dissolvable yarn 3001 may be any synthetic, such as polyester. The second non-dissolvable yarn 3001 may be polyester and the first dissolvable yarn 203 may be any yarn which will dissolve under conditions which will not affect the first non-dissolvable yarn 3002 or the second non-dissolvable yarn 3001, such as rayon, cotton, Lyocell, other cellulosic feedstock, and/or dissolvable synthetic fiber, such as dissolvable polyester. The denier differential between the first non-dissolvable yarn 3002 and the second non-dissolvable yarn 3001 may be at least about 0.54.

A more detailed description of aerographic garments that may be used in accordance with the present invention may be found in U.S. patent application Ser. No. 12/987,249, entitled Aerographics And Denier Differential Zoned Garments, which is incorporated herein by reference.

While the present invention has been described in conjunction with particular examples herein, these examples are not limiting. Any type of visual property or properties may be used to create contrast between various zones on a garment, on different garments, and/or with a visual background. Garments and uniforms in accordance with the present invention may be used with sports beyond soccer, such as (but not limited to) American football, basketball, ice hockey, field hockey, lacrosse, rugby, etc.

Having thus described the invention, what is claimed is:

1. A sports garment worn by a participant in a team sport, the sports garment comprising:

at least a first flicker zone formed from a first set of yarns of a textile forming the sports garment, the first flicker zone comprising a first set of protrusions integrally formed from the first set of yarns of the textile and located at a first location on the sports garment selected to be readily viewed by the wearer's teammates during participation in the team sport, the first flicker zone having a first set of visual properties, wherein at least one visual property of the first set of visual properties is dependent upon a viewing angle; and at least a second zone formed from a second set of yarns of the textile forming the sports garment, the second zone adjacent to the first flicker zone, the second zone further comprising a second set of protrusions integrally formed from the second set of yarns of the textile, the second zone having a second set of visual properties and being substantially non-reflective in a given spectral window, the second set of visual properties being substantially constant from any viewing angle and contrasting with the first set of visual properties.

2. The sports garment of claim 1, wherein the at least one visual property of the first set of visual properties varies from the perspective of the wearer's teammates when the wearer moves during participation in the team sport due to the first flicker zone being occluded.

3. The sports garment of claim 2, wherein the first flicker zone is occluded and revealed by an appendage of the wearer in an alternating fashion during participation in the team sport.

4. The sports garment of claim 1, the first flicker zone further comprising a contoured surface that presents different faces of the contoured surface to the wearer's teammates based on the viewing angle.

5. The sports garment of claim 4, wherein at least some of the different faces of the contoured surface presented to teammates based on the viewing angle possess different sets of visual properties.

6. The sports garment of claim 4, wherein the contoured surface is formed by a molding process.

7. The sports garment of claim 1 wherein the first location is on the side of the wearer when the garment is worn.

8. The sports garment of claim 1, wherein the first flicker zone is affixed to the garment.

9. The sports garment of claim 1, wherein the first flicker zone and second zone further comprise a knit or woven fabric.

10. The sports garment of claim 1 further comprising a textured flicker zone, wherein the textured flicker zone comprises thermal plastics or adhesive tapes.

11. The sports garment of claim 1, wherein the first flicker zone and second zone further comprise heat reactive or moldable yarns.

12. The sports garment of claim 11, wherein the heat reactive or moldable yarns of the first flicker zone and the second zone are heated to create texture within the first flicker zone and the second zone.

13. The sports garment of claim 9, wherein the first set of protrusions and the second set of protrusions are three-dimensional structures formed by the knitted or woven fabric.

14. The sports garment of claim 9, wherein the three-dimensional structures of the first set of protrusions and the second set of protrusions are formed by varying a knitting or a weaving process.

15. The sports garment of claim 9, wherein the first set of visual properties and the second set of visual properties are each varied by changing the knitting process or the weaving process used to create the knitted fabric or the woven fabric.

16. The sports garment of claim 1, wherein first set of protrusions possess a third set of visual properties, and wherein the second set of protrusions possess a fourth set of visual properties.

* * * * *